US009514727B2

(12) United States Patent
Liptac

(10) Patent No.: US 9,514,727 B2
(45) Date of Patent: Dec. 6, 2016

(54) PICKUP WITH ONE OR MORE INTEGRATED CONTROLS

(71) Applicant: DIALTONE PICKUPS, Livermore, CA (US)

(72) Inventor: John Edward Liptac, Livermore, CA (US)

(73) Assignee: DIALTONE PICKUPS, Livermore, CA (US)

( * ) Notice: Subject to any disclaimer, the term of this patent is extended or adjusted under 35 U.S.C. 154(b) by 0 days.

(21) Appl. No.: 14/699,489

(22) Filed: Apr. 29, 2015

(65) Prior Publication Data

US 2015/0317966 A1 Nov. 5, 2015

Related U.S. Application Data

(60) Provisional application No. 61/987,485, filed on May 1, 2014.

(51) Int. Cl.

| | |
|---|---|
| ***G10H 3/00*** | (2006.01) |
| ***G10H 3/18*** | (2006.01) |
| ***G10H 1/12*** | (2006.01) |
| ***G10H 1/32*** | (2006.01) |

(52) U.S. Cl.

CPC ..... *G10H 3/186* (2013.01); *G10H 1/12* (2013.01); *G10H 1/32* (2013.01); *G10H 2220/515* (2013.01)

(58) Field of Classification Search

CPC ..... G10H 3/12; G10H 3/125; G10H 3/183; G10H 1/00; G10H 1/02; G10H 1/34; G10H 1/342; G10H 1/44; G10H 2220/465; G10H 2220/491; G10H 2220/505; G10H 2220/515; G10H 3/06; G10H 3/182; G10H 3/187; H03G 5/165; H04R 17/00; G10G 7/00

See application file for complete search history.

(56) References Cited

U.S. PATENT DOCUMENTS

| | | | | | |
|---|---|---|---|---|---|
| 4,491,051 | A * | 1/1985 | Barcus | G10H 3/143 | 84/728 |
| 4,535,668 | A * | 8/1985 | Schaller | G10H 3/183 | 84/727 |
| 4,762,045 | A * | 8/1988 | Cunningham | G10H 3/185 | 84/728 |
| 4,854,210 | A * | 8/1989 | Palazzolo | G10H 3/181 | 84/726 |
| 4,869,144 | A * | 9/1989 | Lieber | G10H 3/183 | 336/110 |
| 4,907,483 | A * | 3/1990 | Rose | G10H 3/18 | 84/726 |
| 5,637,823 | A * | 6/1997 | Dodge | G10H 1/32 | 84/726 |

(Continued)

*Primary Examiner* — Marlon Fletcher

(74) *Attorney, Agent, or Firm* — Greenblum & Bernstein, P.L.C.

(57) ABSTRACT

A musical instrument pickup, having a pickup body, a tone shaping circuit, and at least one integrated control in and/or on the pickup body. Embodiments of the present disclosure may utilize one or more techniques, alone or in combination, to adjust, e.g., the tone of a musical instrument by changing the frequency response of a pickup with the one or more integrated controls. One exemplary technique utilizes a plurality of knobs to selectively control the gain, resonant frequency, and/or circuit Q of the pickup.

28 Claims, 27 Drawing Sheets

(56) References Cited

U.S. PATENT DOCUMENTS 5,747,711 A * 5/1998 Cavaness ..... G10D 1/085 84/267
5,854,437 A * 12/1998 Merrick ..... G10G 7/02 84/454
5,894,101 A * 4/1999 Damm ..... G10H 3/181 84/723
6,043,422 A * 3/2000 Chapman ..... G10H 1/32 84/723
6,253,654 B1 * 7/2001 Mercurio ..... G10D 1/085 84/267
8,455,750 B1 * 6/2013 Severson ..... G10H 3/183 84/743
8,502,061 B1 8/2013 Alt
9,064,483 B2 6/2015 Alt
2002/0069749 A1 * 6/2002 Hoover ..... G10H 3/26 84/738
2005/0188814 A1 * 9/2005 Bell ..... G10D 1/00 84/298
2005/0211081 A1 * 9/2005 Bro ..... G10H 1/18 84/737
2006/0054009 A1 * 3/2006 Redard ..... G10H 3/183 84/723
2008/0141841 A1 * 6/2008 Van Ekstrom ..... G10D 1/085 84/291
2008/0141843 A1 * 6/2008 Thompson ..... G10D 3/146 84/313
2009/0223353 A1 * 9/2009 Loftus ..... G10H 3/18 84/726
2010/0031800 A1 * 2/2010 Ekstrom ..... G10H 3/183 84/291
2010/0282046 A1 * 11/2010 Crocker ..... G10H 1/32 84/633
2011/0061517 A1 * 3/2011 Haddad ..... G10H 3/06 84/724
2012/0024129 A1 * 2/2012 Ball ..... G10H 1/18 84/602
2014/0069264 A1 * 3/2014 Bialkowski ..... G10H 3/181 84/726
2014/0216235 A1 8/2014 Alt
2015/0059560 A1 * 3/2015 Perea Torres ..... G10H 1/32 84/726
2015/0317966 A1 * 11/2015 Liptac ..... G10H 1/32 84/735

* cited by examiner

PICKUP WITH ONE OR MORE INTEGRATED CONTROLS

CROSS REFERENCE TO RELATED APPLICATION

The present application claims the benefit of U.S. Provisional Application No. 61/987,485 filed on May 1, 2014, the disclosure of which is expressly incorporated by reference herein in its entirety.

FIELD OF THE DISCLOSURE

The present disclosure relates to an instrument pickup. More specifically, the disclosure relates to instrument pickup having one or more integrated controls.

BACKGROUND OF THE DISCLOSURE

Many musicians seek the capability to create a very particular sound or "tone" and will go to great lengths and/or expense in order to produce it. Oftentimes the emulation of a particular tone, or in some cases, the ability to create new sounds is desired. In the context of electric guitar, many factors contribute to the sound of the instrument such as, for example, the type and quality of body material, stress state of the material, and type of transducer or "pickup" used.

Magnetic- and piezo electric-based pickups are the most common, but other methods have been demonstrated to convert the vibration of the strings into an electrical signal. Magnetic pickups are non-linear devices that serve not only to convert vibrations into electrical signals, but also can add tones not originally present in the electrical signal. This is due to, for example, the non-linear interaction of the steel string moving through the non-uniform magnetic field produced by the pickup's permanent magnets.

Electric guitar and bass pickups have been produced in different forms beginning in the 1930s. Many types of magnetic pickups have been produced through the years, which include variations in electromagnetic circuit topology. One of the most common distinctions made with modern day pickups is between "single coil" and dual coil "humbucking" types, which can each have distinctive sounds and can be formed in numerous ways.

A further distinction can also made between "passive" and "active" pickups. Passive magnetic pickups are unpowered and are typically formed from a number of turns of fine wire around a bobbin and some form of magnet. The signal chain of a passive pickup can make use of passive circuit elements such as capacitors, resistors, and potentiometers. In contrast, active pickups require power, but can utilize additional circuit elements such as, for example, operational amplifiers or other integrated circuits to filter and possibly amplify the signal.

In passive pickup configurations, the tone generated by the pickup is primarily set through the details of the electromagnetic circuit employed. Typically the number of turns of wire, magnetic field strength, diameter of wire used, and number coils are selected to produce a characteristic sound. These physical design characteristics translate to engineering parameters such as inductance, capacitance, and resistance. These engineering parameters together create a characteristic frequency response of the pickup, which can be represented through gain, resonant frequency, and circuit Q.

Often times a "tone control" potentiometer is included in (or on) the body of the guitar to give some tonal control (e.g., treble and/or bass) of the sound produced. Musicians, however, sometimes find this tone control insufficient in its ability to produce the desired sound, and resort to swapping various components, including pickups, or entire guitars to find something more to their liking.

Thus, a need exists for an improved musical instrument pickup.

SUMMARY OF THE EMBODIMENTS OF THE DISCLOSURE

One approach to address this need for an improved musical instrument pickup is to give musicians direct control of the pickup's frequency response, and thus, one of the primary parameters for tailoring the instrument's tone. In embodiments, this may be done as simply as possible, for example, giving the user maximum flexibility in adjusting tone with a minimal number of control elements. The present disclosure relates to the ability of musicians to control and tailor their tone to taste with ease through a pickup with one or more integrated control elements.

In accordance with aspects of the disclosure, an active pickup may utilize one or more integrated control elements to allow a musician control over the frequency response, and thus, tone of the instrument. In embodiments, the pickup with integrated controls is not limited to a fixed frequency response as are traditional pickups, but rather, the frequency response can be adjusted until desirable tones are obtained. In accordance with aspects of the disclosure, this provides maximum flexibility in adjusting tone as simply as possible.

Aspects of the present disclosure are directed to a musical instrument pickup, comprising: a pickup body; a tone shaping circuit; and at least one integrated control in and/or on the pickup body.

In embodiments, the at least one integrated control comprises two integrated controls.

In further embodiments, the at least one integrated control comprises more than two integrated controls.

In additional embodiments, the at least one integrated control is configured to vary one or more parameters of the tone shaping circuit to adjust a frequency response and/or volume of the pickup.

In yet further embodiments, the at least one integrated control is configured to adjust at least one of a peak resonant frequency of the pickup, a Q for the pickup, a volume of the pickup, gain of the pickup, and equalization of the pickup.

In embodiments, the two integrated control comprise rotationally-actuated knobs structured and arranged at respective longitudinal ends of the pickup body.

In further embodiments, the two integrated controls are structured and arranged at respective rounded corners of the pickup body.

In additional embodiments, the pickup further comprises a printed circuit board having the tone shaping circuit, wherein each of the at least one integrated control comprises a potentiometer mounted to the printed circuit board and having a mounting post projecting through the pickup body, and an actuator element arranged in an external surface cavity of the pickup body and mounted to the mounting post In yet further embodiments, the potentiometer is mounted to a top surface of the printed circuit board.

In embodiments, the potentiometer is mounted to a side surface of the printed circuit board.

In further embodiments, the at least one integrated control is structured and arranged such that the at least one integrated control does not project beyond an outer perimeter of the pickup body.

In additional embodiments, the pickup is configured as a humbucker pickup.

In yet further embodiments, the pickup is configured as a single coil pickup.

In embodiments, the at least one integrated control is a rotary actuator having a rotational axis perpendicular to an upper surface of the printed circuit board.

In further embodiments, the at least one integrated control is a rotary actuator having a rotational axis parallel to an upper surface of the printed circuit board.

In additional embodiments, the pickup body includes four rounded corners, which include two larger rounded corners where the two actuator elements are respectively structured and arranged, and two smaller rounded corners opposite the two larger rounded corners.

In yet further embodiments, the pickup further comprises a pickup ring structured and arranged to surround a perimeter of the pickup body.

In embodiments, at least one of the pickup body and the pickup ring include indicator features for the at least one integrated control.

In further embodiments, the pickup ring includes one or more recessed areas to provide increased access to the at least one integrated control.

In additional embodiments, the at least one integrated control includes a locking element structured and arranged to releasably lock a relative position of the integrated control.

In yet further embodiments, the at least one integrated control comprises one of or more of a rotationally-actuated knob, a switch, a slider, and a button.

Additional aspects of the present disclosure are directed to a pickup ring structured and arranged to surround the pickup of claim 1, the pickup ring having four internal rounded corners, wherein two of the internal rounded corners have a larger relative radius, and the remaining two internal rounded corners have a smaller relative radius.

BRIEF DESCRIPTION OF THE DRAWINGS

For a more complete understanding of the disclosure, as well as other aims and further features thereof, reference may be had to the following detailed description of the disclosure in conjunction with the following exemplary and non-limiting drawings wherein.

Reference numbers refer to the same or equivalent parts of the present invention throughout the various figures of the drawings.

DETAILED DESCRIPTION OF THE EMBODIMENTS OF THE DISCLOSURE

In the following description, the various embodiments of the present disclosure will be described with respect to the enclosed drawings.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description is taken with the drawings making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range. For example, if a range is from about 1 to about 50, it is deemed to include, for example, 1, 7, 34, 46.1, 23.7, or any other value or range within the range.

The various embodiments disclosed herein can be used separately and in various combinations unless specifically stated to the contrary.

Figure 1:
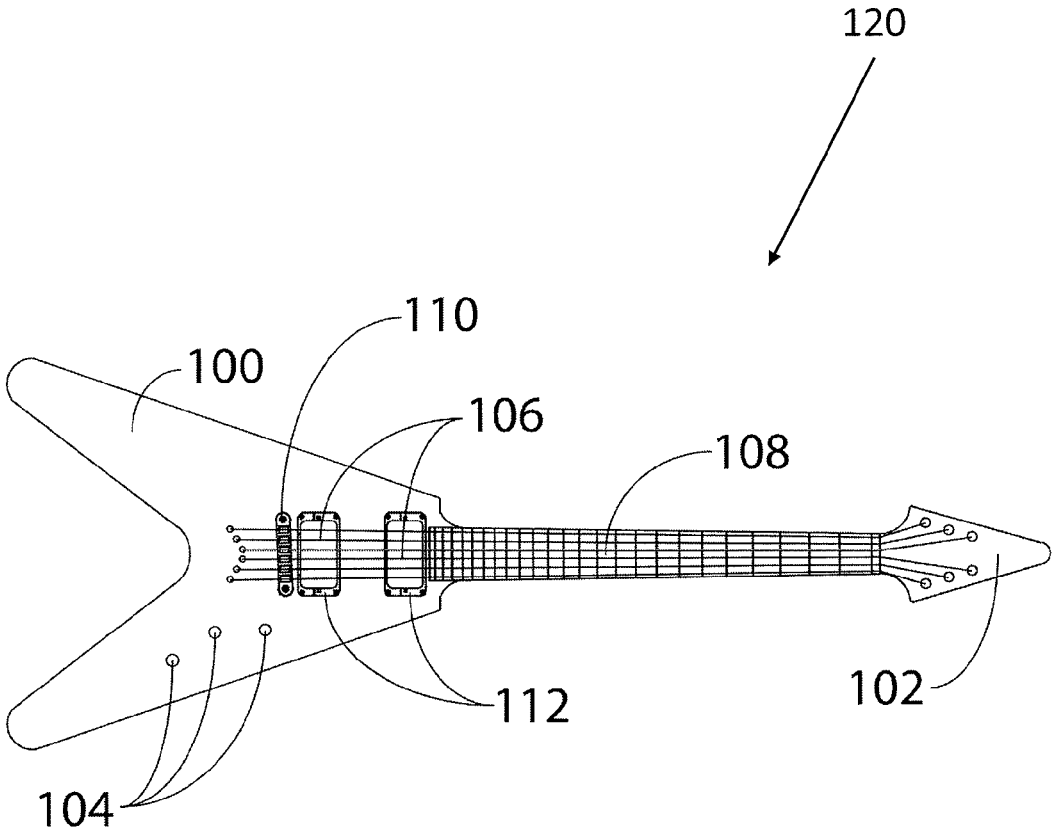
FIG. 1 shows a top view of an exemplary guitar.

FIG. 1 shows a top view of an exemplary guitar 120. As shown in FIG. 1, the guitar 120 (and other stringed instruments, e.g., bass guitars, mandolins) typically include a head 102, neck 108, and body 100. In the case of electric guitars 120, pickups 106 are usually located beneath the strings and countersunk into the body 100. Pickup rings 112 surround the pickups 106 and are sometimes used to adjust the height and angle of the pickup 106 relative to the strings 108. The bridge 110 is attached to (or rests upon) the body 100, and may be used to set string height and intonation. Many configurations of pickups 106 in the guitar 120 are possible, but typically one, two, or three pickups 106 (e.g., single coil pickups and/or humbucker pickups) are used depending on the preference of the musician and/or the particular configuration of the guitar 120. The exemplary and non-limiting embodiment of FIG. 1 shows a common configuration with two humbucking-style (or humbucker) pickups. Oftentimes control elements 104 are built into the guitar body. Such control elements 104 include switches (e.g., slider, blade, and/or rotary switches or dials) for controlling which pickup or pickup combination is used and volume and/or tone potentiometers (or pots). For example, tone potentiometers may include a single overall tone potentiometer, a tone potentiometer for each respective pickup, a bass tone potentiometer, and/or a treble tone potentiometer. For example, volume potentiometers may include a single overall volume potentiometer or volume potentiometers for each respective pickup.

Figure 2:
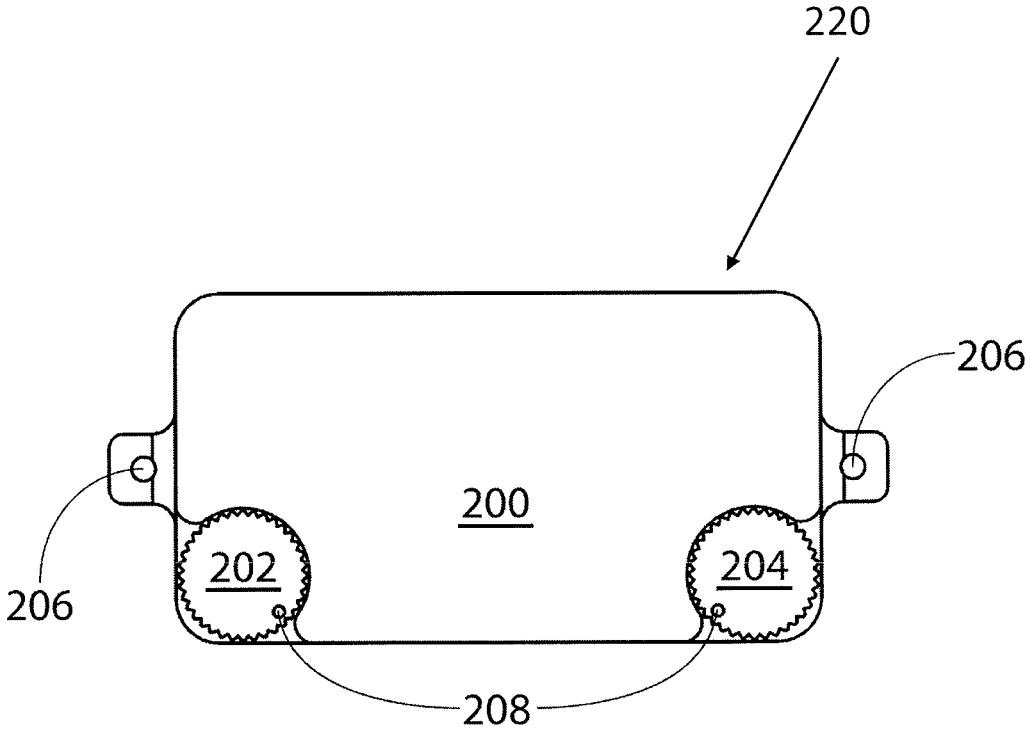
FIG. 2 shows a top view of an exemplary pickup with integrated controls in accordance with aspects of the disclosure.

FIG. 2 shows a top view of an exemplary pickup 220 with integrated controls in accordance with aspects of the disclosure. As shown in FIG. 2, additional control over tone of the pickup may be obtained by integrating one or more control (or actuator) elements 202, 204 into the pickup 220 itself. Advantageously, doing so in accordance with aspects of the disclosure adds minimal complexity while avoiding the need for woodworking and guitar body modification. FIG. 2 shows one exemplary embodiment for a pickup 220 with integrated controls. With this exemplary and non-limiting embodiment, two actuator elements 202 and 204 are integrated into the pickup body 200. In embodiments, the pickup body 200 may be composed of plastic, metal, and/or composite materials. In embodiments, actuator elements may be mechanical components, such as knobs, slides, and/or buttons, for example. Additional examples of control (or actuator) elements include capacitive, inductive, and resistive controls, which can be actuated by touching a surface of the control. In this exemplary and non-limiting embodiment, the actuator elements are knobs 202 and 204 (having indicators 208) for adjusting analog potentiometers (not shown) to which the knobs 202 and 204 are respectively attached. While not shown in FIG. 2, the disclosure contemplates that indicators may also be included on the pickup body or on the pickup ring to further identify desirable settings. In embodiments, the actuator elements 202 and 204 are recessed into the pickup body to avoid interference with the strings and/or to maintain playability. In embodiments, the actuator elements 202 and 204 are also situated in respective corners of the pickup body 200 to facilitate adjustment while playing. As shown in FIG. 2, the pickup 220 also includes mounting holes 206 to utilize screws, springs, and a pickup ring assembly for pickup attachment and/or height adjustment.

In one exemplary embodiment, actuator elements may be used as polyphonic switches that control the output circuit path for signals produced from each string.

Figure 3:
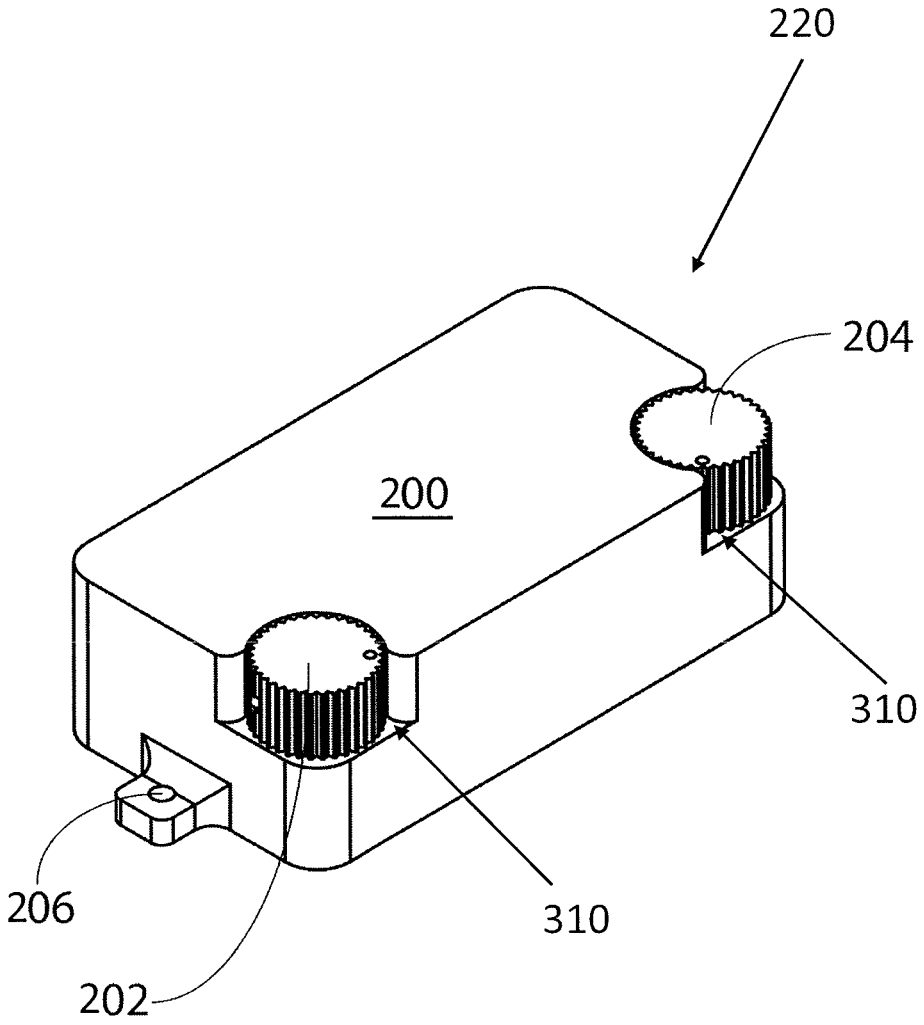
FIG. 3 shows a perspective view of the exemplary pickup with integrated controls of FIG. 2 in accordance with aspects of the disclosure.

FIG. 3 shows a perspective view of the pickup 220 shown in FIG. 2 with integrated controls. FIG. 3 more clearly shows access to the actuator elements 202 and 204, as well as the recessed regions 310 of the pickup body 200. In embodiments, the pickup body 200 may be formed through industrial processes such as, for example, casting, injection molding, and/or stamping. Alternatively, the pickup body 200 may be formed through 3D printing using one or more of a variety of materials. In accordance with aspects of the disclosure, materials with high electrical conductivity may be utilized to provide shielding from unwanted electromagnetic interference. As shown in FIG. 3, in embodiments, the mounting holes 206 may be integrated into the pickup body 200.

Different actuator elements may be used to control specific parts of the circuit and influence tone. For example, with one exemplary and non-limiting embodiment, actuator element 202 may be configured to adjust resonance frequency, while actuator element 204 may be configured to adjust circuit "Q" of the tone circuit. As should be understood by the ordinarily skilled artisan, the resonant frequency is a frequency at which the response amplitude is a relative maximum. At resonant frequencies, small periodic driving forces have the ability to produce large amplitude oscillations. As should be understood by the ordinarily skilled artisan, the "Q" characterizes a resonator's bandwidth relative to its center frequency. "Q" (or "circuit Q") is a dimensionless parameter that compares the exponential time constant $\tau$ for decay of an oscillating physical system's amplitude to its oscillation period. Equivalently, "Q" compares the frequency at which a system oscillates to the rate at which it dissipates its energy.

In one exemplary embodiment, resonant frequency and Q are controlled via adjustments of the actuator elements 202 and 204, respectively, on the pickup 220, while gain (or volume) is controlled through one or more body control element 104. In addition to frequency characteristics, in accordance with additional aspects of the disclosure, signal amplitude, and thus, volume and overdrive and/or tone can also be tailored in a similar manner. For example, in embodiments, actuators (e.g., 202 or 204, or additional integrated actuators) may be configured to control overall volume (and overdrive) of the pickup and/or overall tone of the pickup.

In embodiments of the present disclosure, the tone circuit may be configured to allow a user to adjust the gain or output level in addition to shaping the frequency response. In embodiments, adding a gain control may be done by using a jumper or potentiometer. For example, a jumper with a fixed resistance may be used on the pickup itself to set a particular output level. Swapping the jumper for a jumper having a different resistance value allows different output levels to be realized. With an exemplary and non-limiting embodiment, the pickup includes one or more pins underneath the pickup (not shown) that can be used with different jumpers to set different fixed levels of gain. In further embodiments, an additional potentiometer can also be connected to the tone circuit to allow an adjustable output level. Typically this potentiometer is placed in the body of the guitar, oftentimes replacing the location where a tone potentiometer would be located. For example, in embodiments, an additional gain knob (e.g., potentiometer) may be accommodated on the guitar (or one of a guitar's tone knobs may be replaced with a gain knob), which is configured to adjust the gain of the tone circuit, to allow the user to make gain adjustments.

Figure 4:
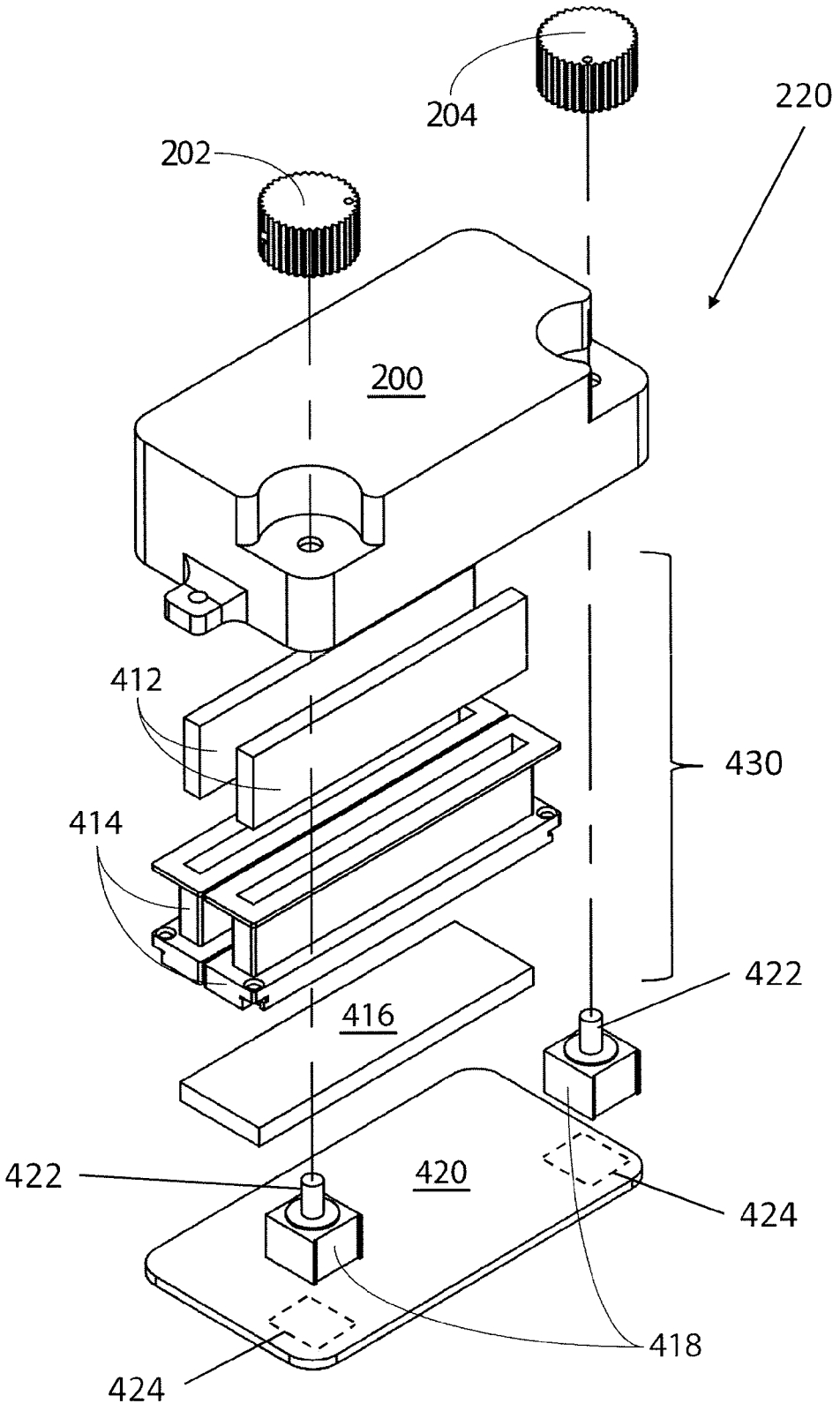
FIG. 4 shows an exploded view of an exemplary pickup with integrated controls of FIG. 2 in accordance with aspects of the disclosure.

FIG. 4 shows an exploded view of the exemplary pickup 220 with integrated controls in accordance with aspects of the disclosure. As shown in FIG. 4, a printed circuit board 420 forms the base of the pickup 220 and contains tone shaping circuit elements (not shown in FIG. 4), which may be either analog, digital, or mixed signal in nature, for example. Internal control elements 418 are mounted to the printed circuit board 420. In this exemplary embodiment, the internal control elements 418 are potentiometers and include shafts 422 extending through the pickup body 200 upon which actuator elements 202 and 204 are attached.

With this exemplary embodiment, a magnetic assembly 430 is formed from wire (not shown) wrapped around a bobbin 414, bar permanent magnets 412, and a flux transfer element 416. With an alternative embodiment, the flux transfer elements 416 could be arranged where the permanent magnets 412 are shown, and the permanent magnet 412 would be where the flux transfer element 416 is shown. Flux transfer elements 416 are ferrous metals, including, but not limited to low-carbon steel. Permanent magnets 412 may be made from materials including but not limited to ceramic, alnico, neodymium and/or samarium cobalt.

Although the tone circuit provides a great deal of flexibility in terms of producing a wide range of tones it is still possible for a user to hear the effect of the details of the construction of the magnetic assembly, which gives a characteristic sound. In accordance with aspects of the disclosure, in embodiments the characteristic sound may be adjusted. For example, to adjust this characteristic sound, additional capacitance may be added into system, e.g., in the form of surface mount capacitors (not shown) located on the circuit board. In accordance with aspects of the disclosure, the additional capacitance adjusts the natural resonant frequency of the pickup.

Figure 5:
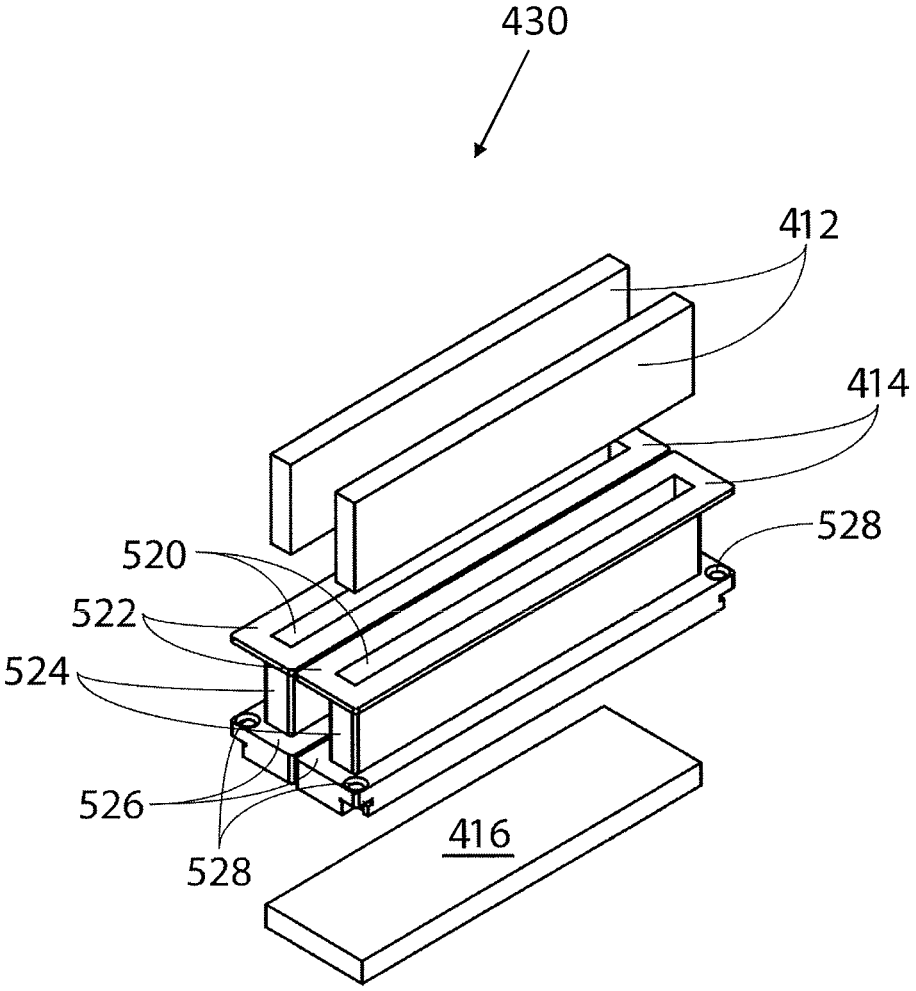
FIG. 5 shows an exploded view of an exemplary bar magnet assembly in accordance with aspects of the disclosure.

FIG. 5 shows an exploded view of the exemplary bar magnet assembly 430 in accordance with aspects of the disclosure, in which the magnetic assembly 430 is shown in more detail. The bar permanent magnets 412 fit into pockets 520 within the bobbins 414. Each bobbin 414 includes a top flange 522, a winding surface 524, and a bottom flange 526. Wire (not shown) is wound around the winding surface 524 until a sufficient number of turns are built up, as is understood by the skilled artisan.

Depending on the desired output, a number of turns of the wire (typically about 5,000) are wrapped around the bobbin 414. Typically, fine magnet wire is used with 42 AWG or 44 AWG being common, but the disclosure contemplates that any suitable wire could be utilized. A feedthrough feature 528 within the bobbin allows easier access to, and facilitates electrical communication with, the printed circuit board (not shown). The flux transfer element 416 can be used to link (e.g., electrically and/or magnetically) the permanent magnets 412.

Embodiments shown thus far describe a humbucking pickup configuration (i.e., two single coils pickups side-by-side with reverse orientation) where the magnetic polarities and coil winding direction are combined in such a way as to cancel "hum" (or electromagnetic interference). Further embodiments utilizing single coil or polyphonic configurations are also contemplated by the present disclosure. Even within a particular humbucking topology, many configurations for magnetic assemblies are possible. Further examples of configurations for magnetic assemblies are shown in FIGS. 6 and 7.

Figure 6:
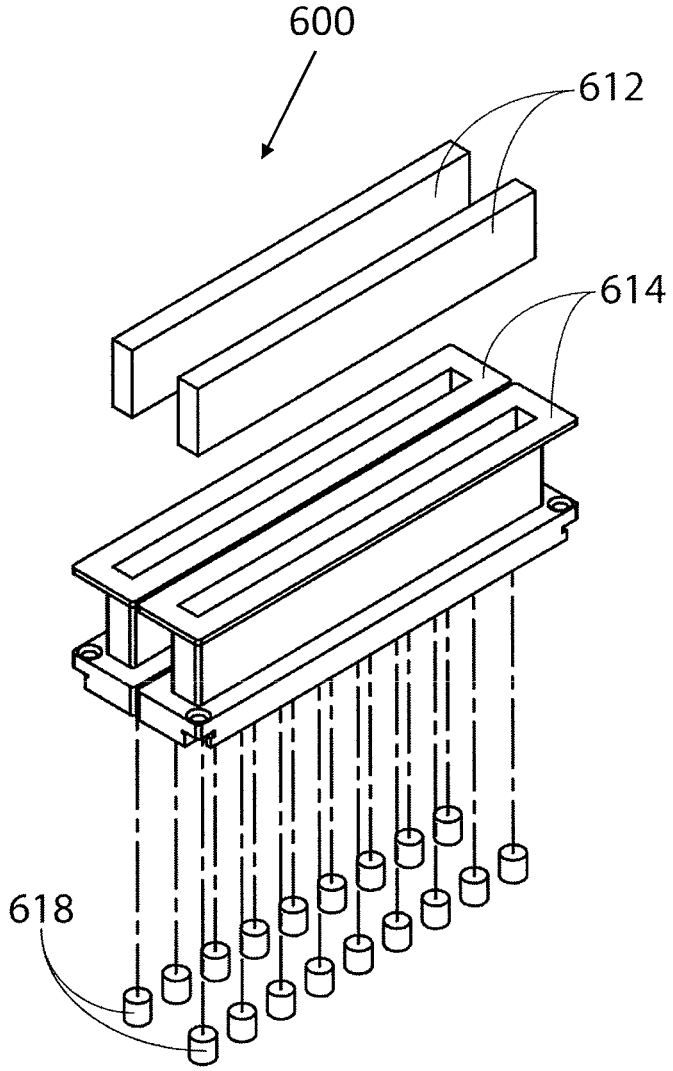
FIG. 6 shows an exploded view of an exemplary disc magnet assembly in accordance with aspects of the disclosure.

FIG. 6 shows an exploded view of an exemplary disc magnet assembly 600 in accordance with aspects of the disclosure, which is another example of a possible magnetic assembly. This exemplary and non-limiting embodiment includes flux transfer elements 612 and permanent disc magnets 618 providing the magnetic field. The bobbin 614 is then shaped with recesses and pockets as needed, such that the bars and discs fit flush within the bobbin 614.

Figure 7:
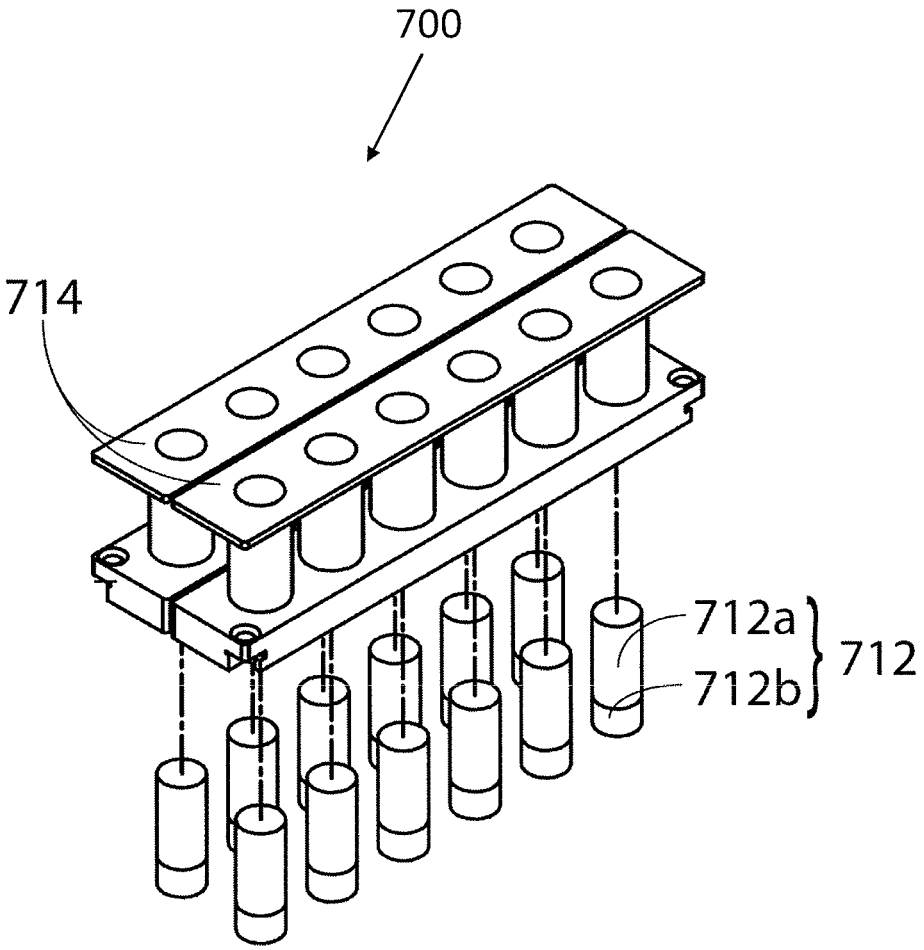
FIG. 7 shows an exploded view of an exemplary magnetic stack assembly in accordance with aspects of the disclosure.

FIG. 7 shows an exploded view of an exemplary magnetic stack assembly 700 in accordance with aspects of the disclosure. Many combinations of shaped bobbins, magnets, and flux transfer elements are possible and within the scope of the present disclosure. In a third exemplary and non-limiting embodiment of the magnetic stack assembly 700, columnar bobbins 714, are used with a magnetic stack 712. In embodiments, each stack includes a flux transfer element 712*a* and a permanent magnet 712*b*. Alternatively, in embodiments, the magnetic stack may be a single rod magnet.

A columnar form (e.g., as shown in FIG. 7) can also be used to form polyphonic elements where a winding per string is used. For example, this would give six individual coils for a six stringed instrument. If a humbucking pickup configuration is desired, then 12 individual coils would be utilized.

Figure 8:
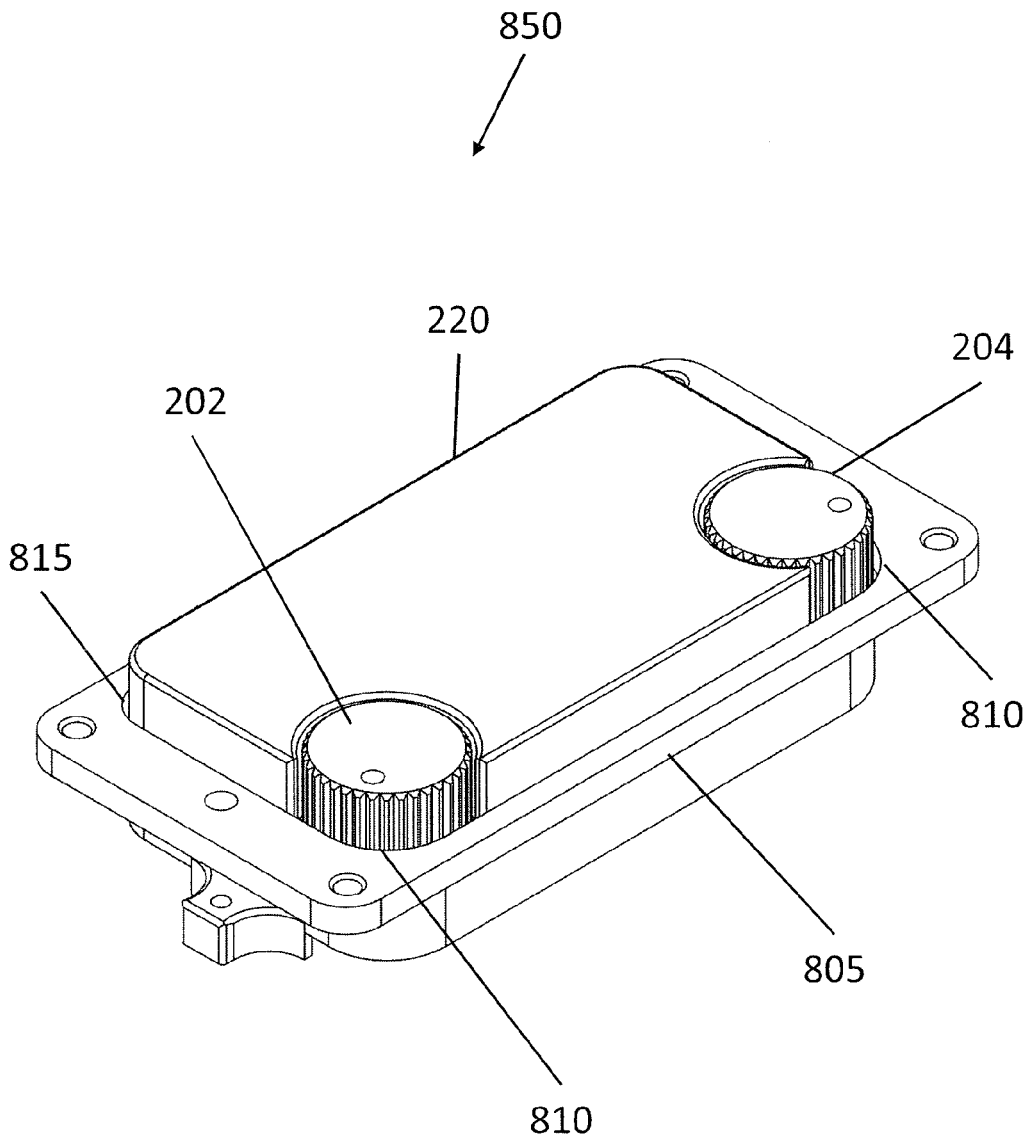
FIG. 8 shows a perspective view of an exemplary pickup with integrated controls with an exemplary pickup ring in accordance with aspects of the disclosure.

FIG. 8 shows a perspective view 850 of an exemplary pickup 220 with integrated controls and with an exemplary pickup ring 805 in accordance with aspects of the disclosure. As shown in FIG. 8, the pickup ring is structured and arranged to surround a perimeter of the pickup 220, and is sized accordingly. Moreover, as shown in FIG. 8, in accordance with aspects of the disclosure, the pickup ring has two inner "corners" 810 (e.g., rounded corners) having a larger relative radius, and two other inner "corners" 815 (e.g., rounded corners) having a smaller relative radius. As shown in FIG. 8, inner corners 810 correspond with the location of the actuator elements 202, 204. Inner corners 815 correspond with the "corners" of the pickup 220 that do not include any actuator elements. In accordance with aspects of the disclosure, the "corners" 810 having a larger relative radius allow for a larger size of the actuator elements 202, 204 than would be achievable with a standard pickup ring (in which all four inner "corners" have a common radius). That is, by increasing the radius of the corners 810, larger diameter actuator elements (which may be easier to access and actuate) can be arranged in the pickup. In accordance with aspects of the disclosure, a larger-diameter actuator element allows the user to more easily access the actuator elements to make adjustments.

Figure 9:
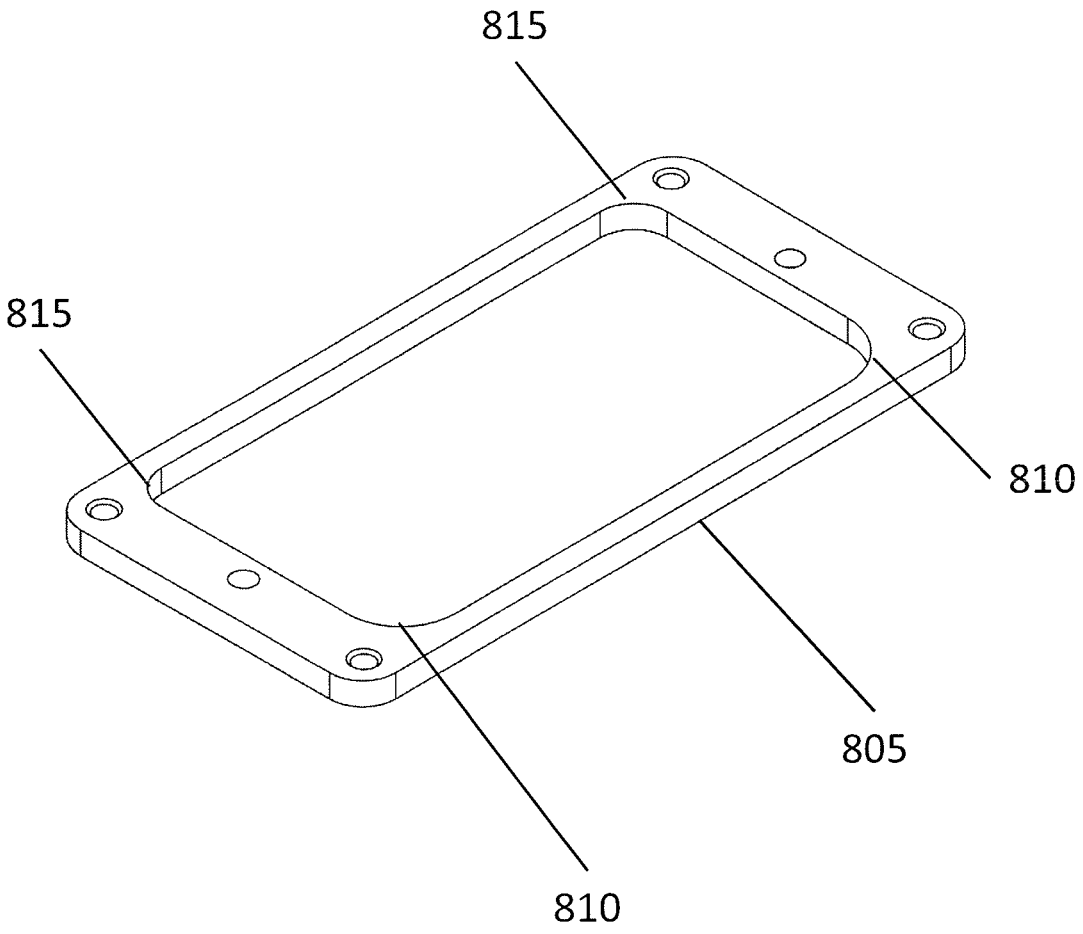
FIG. 9 shows a perspective view of the pickup ring shown in FIG. 8 in accordance with aspects of the disclosure.

FIG. 9 shows a perspective view of the pickup ring 805 shown in FIG. 8 in accordance with aspects of the disclosure. FIG. 9 shows the pickup ring 805 without the pickup itself, so as to more clearly illustrate aspects of the pickup ring 805. As shown in FIG. 9, in accordance with aspects of the disclosure, the pickup ring has two inner "corners" 810 having a larger relative radius, and two other inner "corners" 815 having a smaller relative radius.

Figure 10:
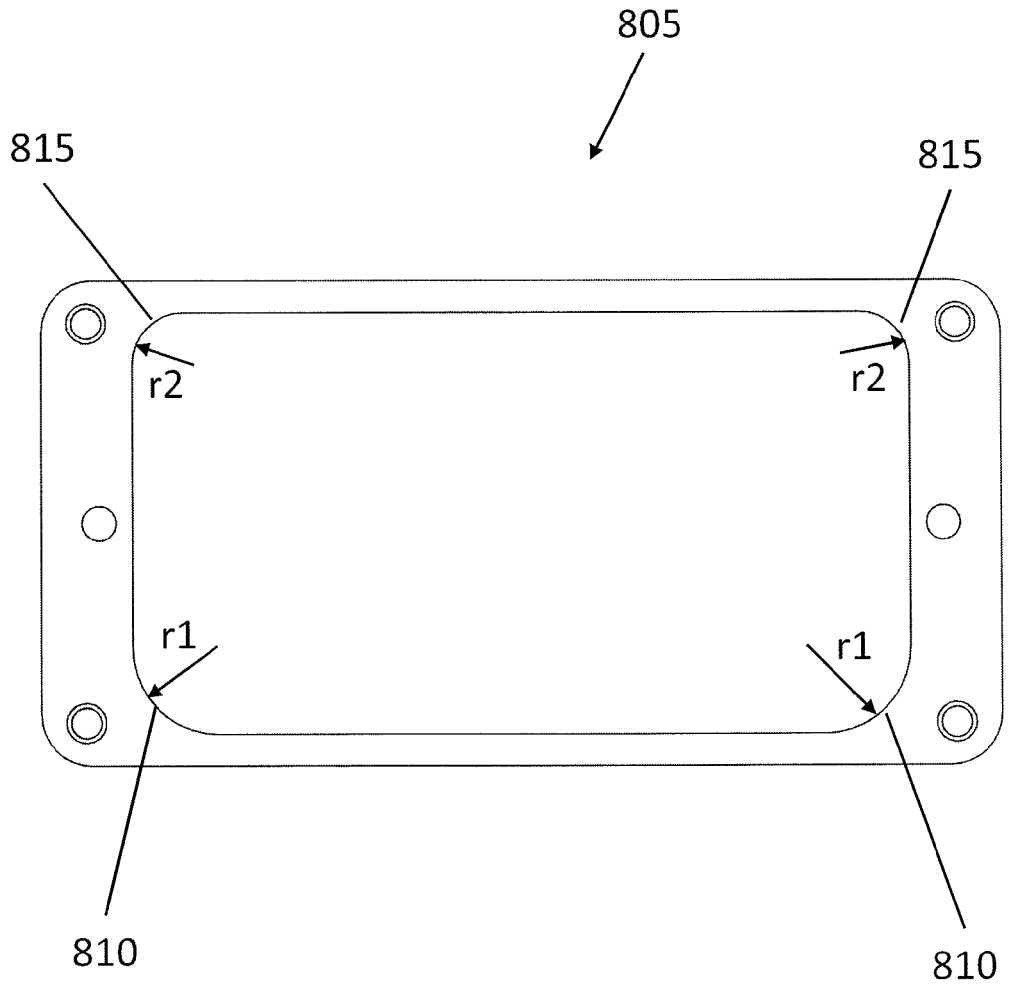
FIG. 10 shows a top view of the pickup ring shown in FIG. 9 in accordance with aspects of the disclosure.

FIG. 10 shows a top view of the pickup ring 805 shown in FIG. 9 in accordance with aspects of the disclosure. As shown in FIG. 10, the pickup ring has two inner "corners" 810 (e.g., rounded corners) having a larger relative radius r1, and two other inner "corners" 815 (e.g., rounded corners) having a smaller relative radius r2. With an exemplary and non-limiting embodiment, r1 is approximately ⅝" and r2 is approximately ⅜".

Figure 11:
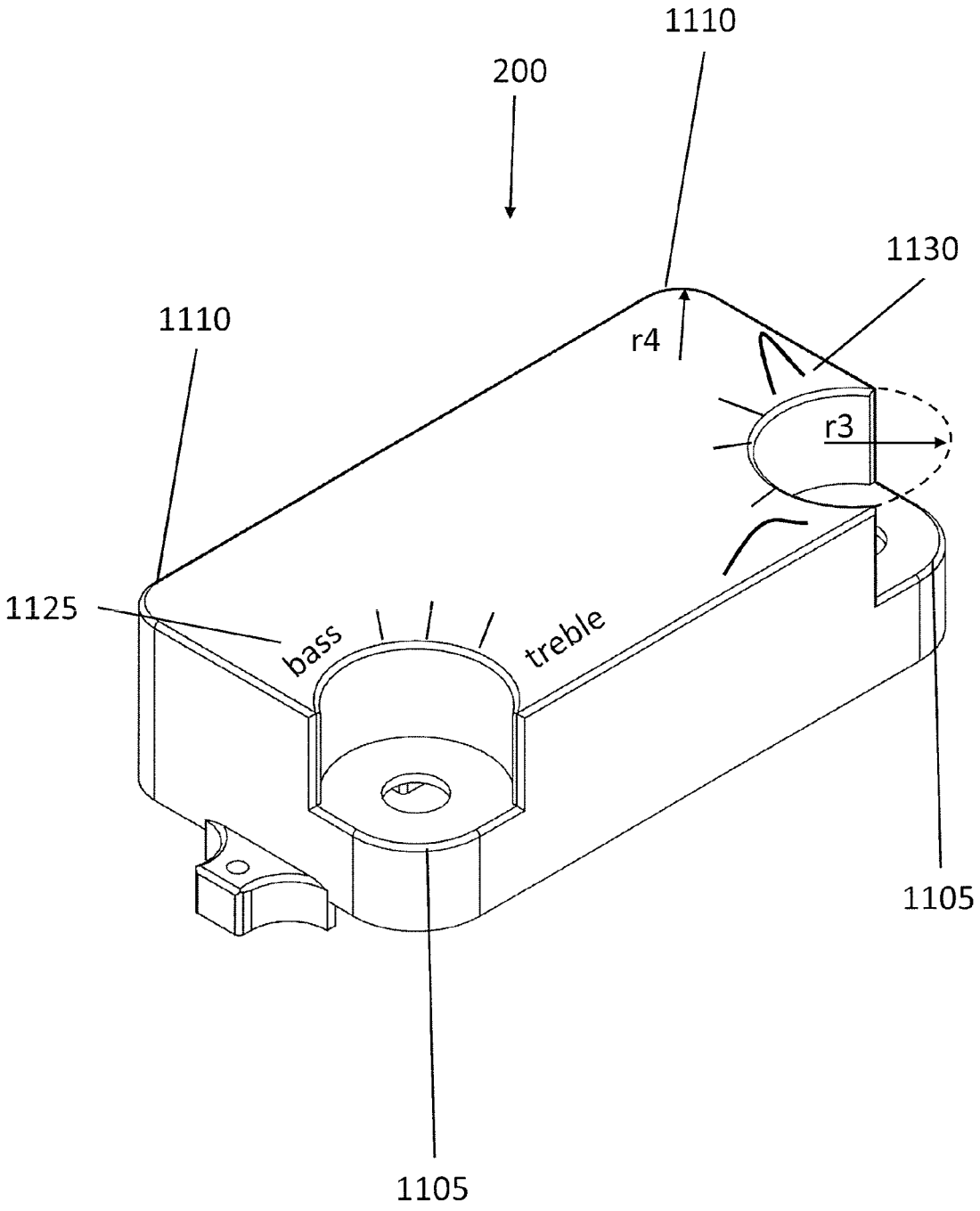
FIG. 11 shows a perspective view of an exemplary pickup body (or housing) in accordance with aspects of the disclosure.

FIG. 11 shows a perspective view of an exemplary pickup body 200 in accordance with aspects of the disclosure. FIG. 11 shows the pickup body 200 without the actuator elements so as to more clearly illustrate aspects of the pickup body 200. As shown in FIG. 11, in accordance with aspects of the disclosure, the pickup body 200 has "corners" 1105 (e.g., rounded corners) having a larger relative radius r3, and two other "corners" 1110 (e.g., rounded corners) having a smaller relative radius r4. In accordance with aspects of the disclosure, the "corners" 1105 have a larger relative radius to accommodate a larger size of the actuator elements 202, 204 than would be achievable with a standard pickup body shape (in which all inner "corners" have a common radius). With an exemplary and non-limiting embodiment, r3 is approximately ⅝" and r4 is approximately ⅜". As should be understood, however, r3 may be slightly smaller than r1, and r4 may be slightly smaller than r2 (see, e.g., FIG. 10) so that the pickup ring (not shown) properly fits around the perimeter of the pickup body 200.

As shown in FIG. 11, in embodiments, the disclosure contemplates that indicators 1125 and 1130 may also be included on the pickup body or on the pickup ring (not shown) to further identify variable parameters and/or desirable settings for each of the actuator elements. Indicators 1125 to help identify variable parameters for the resonant frequency actuator element may include, for example, identifications for the ends of the range (e.g., bass and treble), frequency scale (e.g., in Hz), and/or hash marks. Indicators 1130 to help identify variable parameters for the Q (or circuit Q) actuator element may include, for example, representative depictions of the resulting frequency response curve (e.g., narrow high peak and/or wider shallow peak), and/or hash marks.

Figure 12:
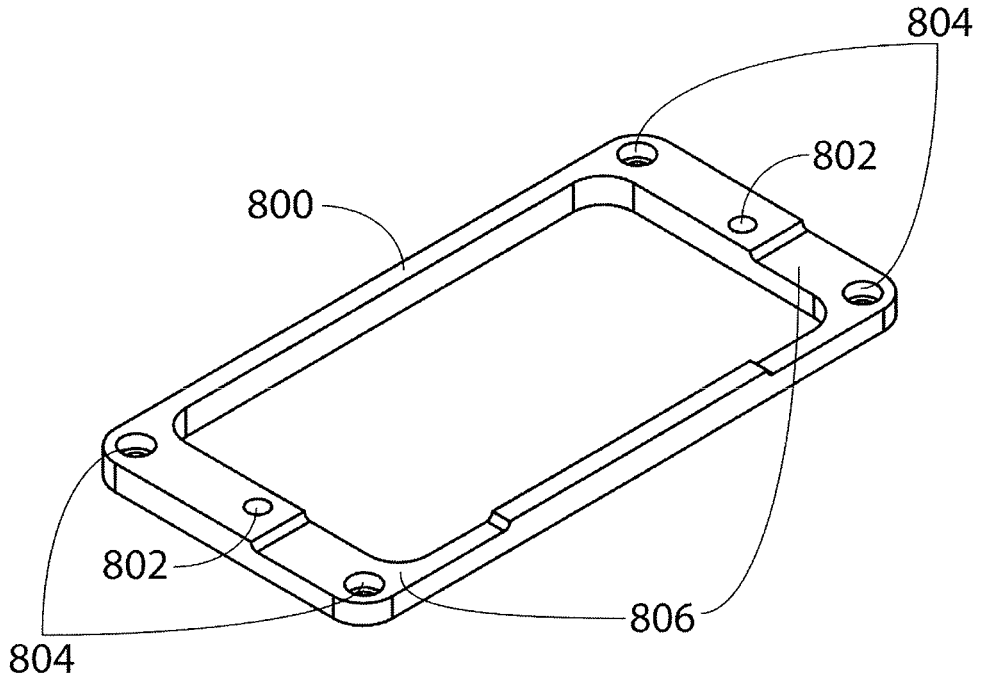
FIG. 12 shows a perspective view of an exemplary pickup ring in accordance with aspects of the disclosure.

FIG. 12 shows a perspective view of an exemplary pickup ring 800 in accordance with aspects of the disclosure. As shown in FIG. 12, pickup ring 800 is shaped or structured to allow easier access to actuator elements (not shown) by including recessed areas 806. A hole pattern 804 allows the pickup ring 800 to be securely fastened to the body of a musical instrument, e.g., guitar, (not shown). Additional holes 802 allow the pickup's height and angle to be adjusted when used in conjunction with a spring and screw setup (as understood by the ordinarily-skilled artisan). Indicator features (not shown) may also be included on the pickup ring to help identify actuator element positions that give desirable sounds. Indicator features may include, for example, notch marks, a numbered scale, an un-numbered scale, end-of-range labels (e.g., bass frequency, treble frequency), approximate frequency response curve shapes (e.g., for the extremes of the actuator positions), amongst other suitable indicator features.

Figure 13:
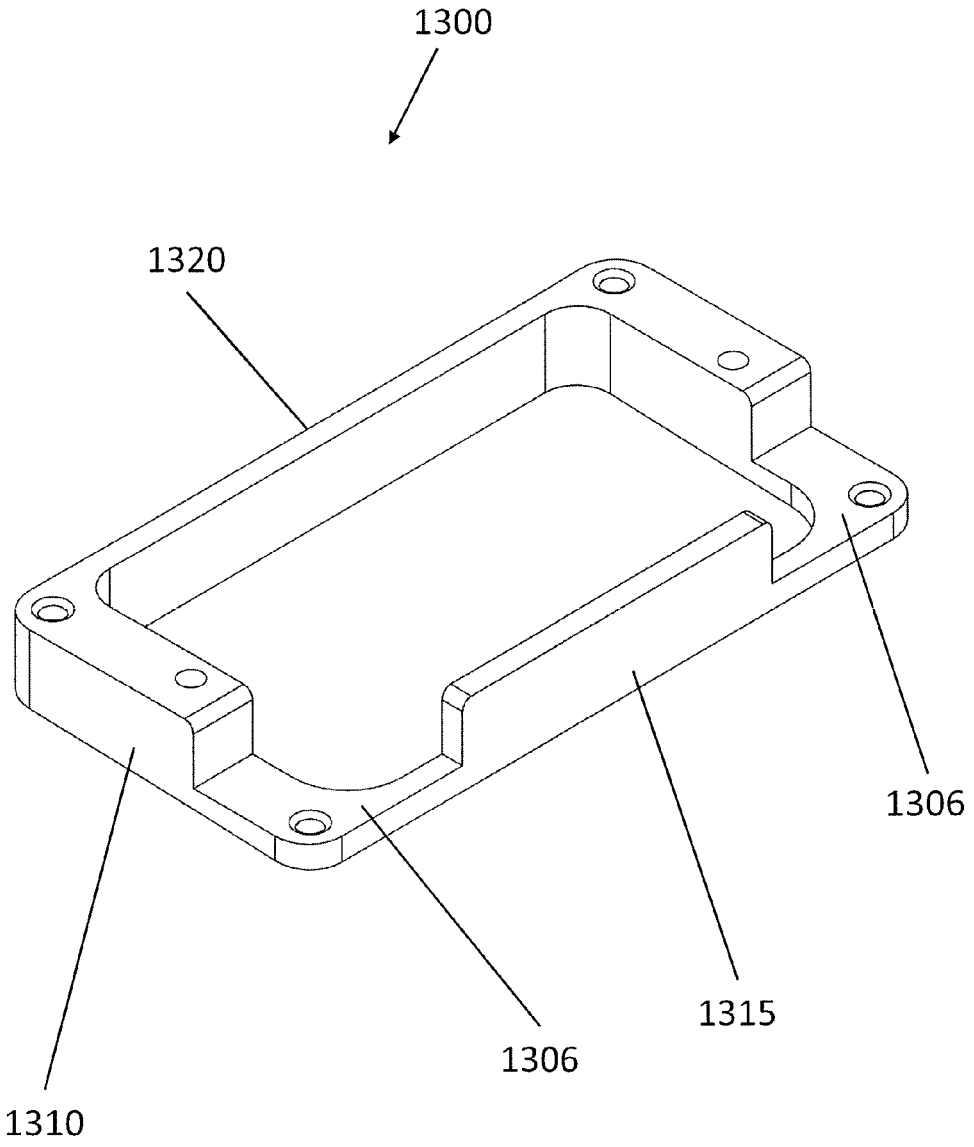
FIG. 13 shows a perspective view of an exemplary pickup ring in accordance with aspects of the disclosure.

FIG. 13 shows a perspective view of an exemplary pickup ring 1300 in accordance with aspects of the disclosure. As shown in FIG. 13, in comparison to the embodiment shown in FIG. 12, the overall thickness of the pickup ring 1300 is larger. Moreover, in accordance with aspects of the disclosure, the pickup ring 1300 may include a tapered base 1310, in which the thickness of the pickup ring 1300 at the bridge side 1315 (i.e., the side facing towards the bridge of the instrument) is larger than the thickness of the pickup ring at the neck side 1320 (i.e., the side facing towards the neck of the instrument). In accordance with aspects of the disclosure, by utilizing the pickup ring 1300 with the tapered base 1310, the pickup (not shown) is tilted to provide easier access to the actuator elements (not shown).

Figure 14:
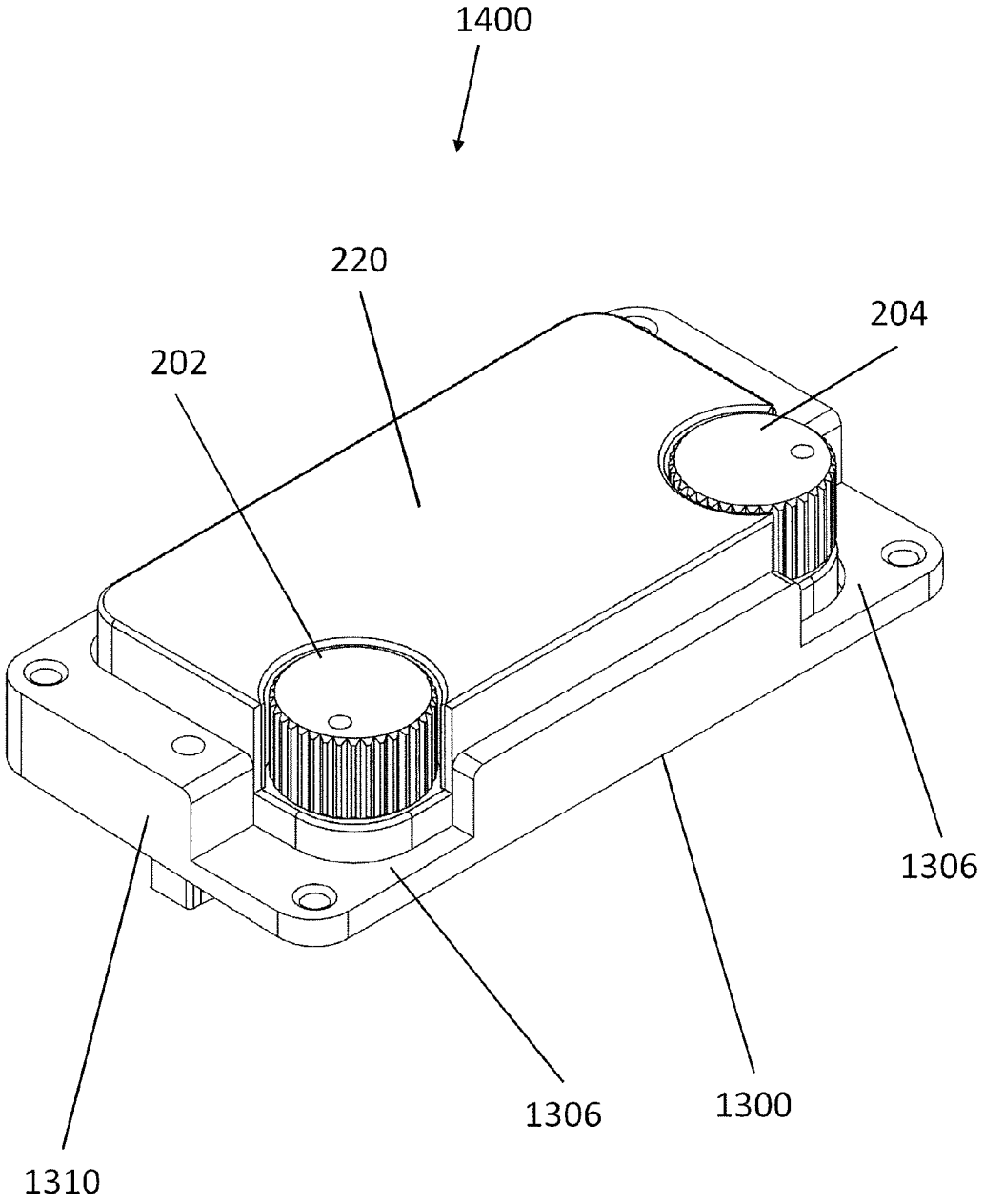
FIG. 14 shows a perspective view of an exemplary pickup with integrated controls with the exemplary pickup ring of FIG. 13 in accordance with aspects of the disclosure.

FIG. 14 shows a perspective view 1400 of an exemplary pickup 220 with integrated controls with the exemplary pickup ring 1300 in accordance with aspects of the disclosure. As shown in FIG. 14, the pickup ring 1300 includes recessed areas 1306 to allow easier access to actuator elements 202, 204 of the pickup 220.

Figure 15:
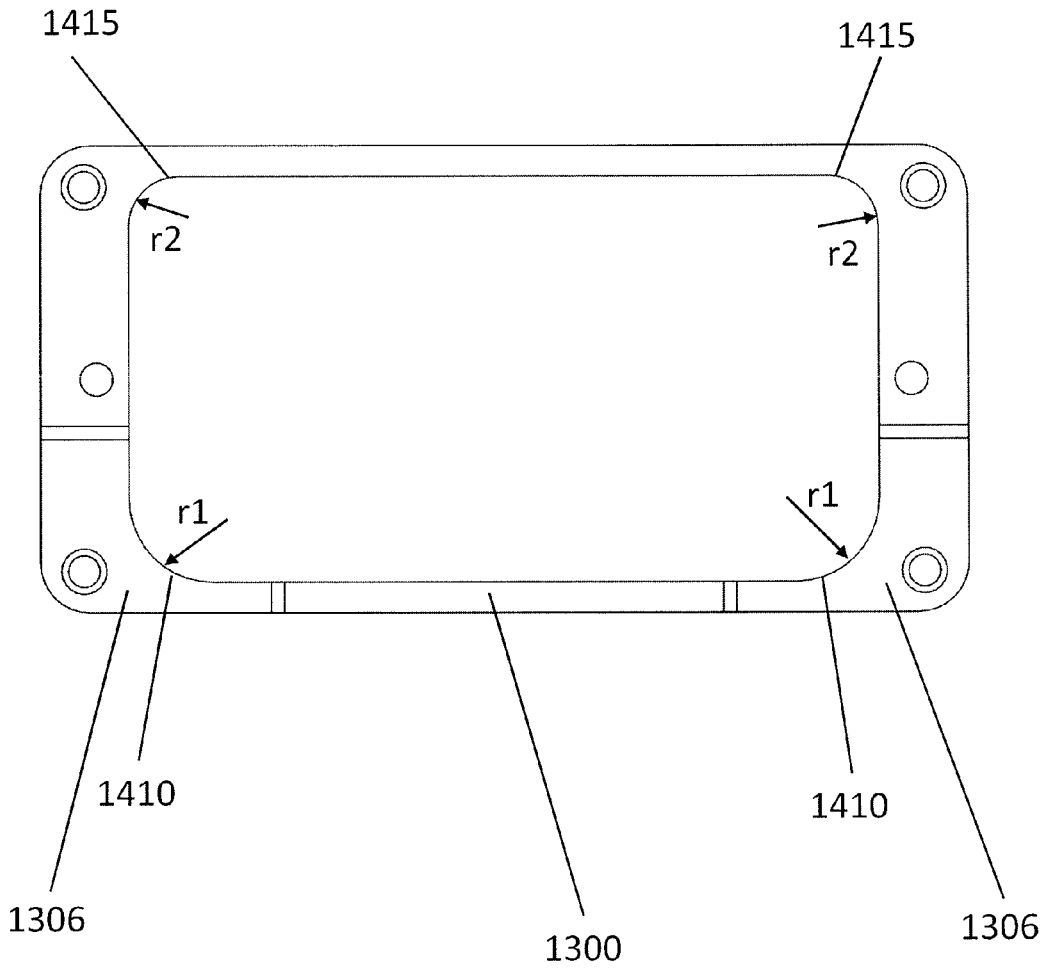
FIG. 15 shows a top view of the exemplary pickup ring shown in FIG. 13 in accordance with aspects of the disclosure.

FIG. 15 shows a top view of the exemplary pickup ring 1300 shown in FIG. 13 in accordance with aspects of the disclosure. As shown in FIG. 15, the pickup ring 1300 has two inner "corners" 1410 (e.g., rounded corners) located in the region of recessed areas 1306 having a larger relative radius r1, and two other inner "corners" 1415 (e.g., rounded corners) having a smaller relative radius r2. With an exemplary and non-limiting embodiment, r1 is approximately ⅝" and r2 is approximately ⅜".

Figure 16:
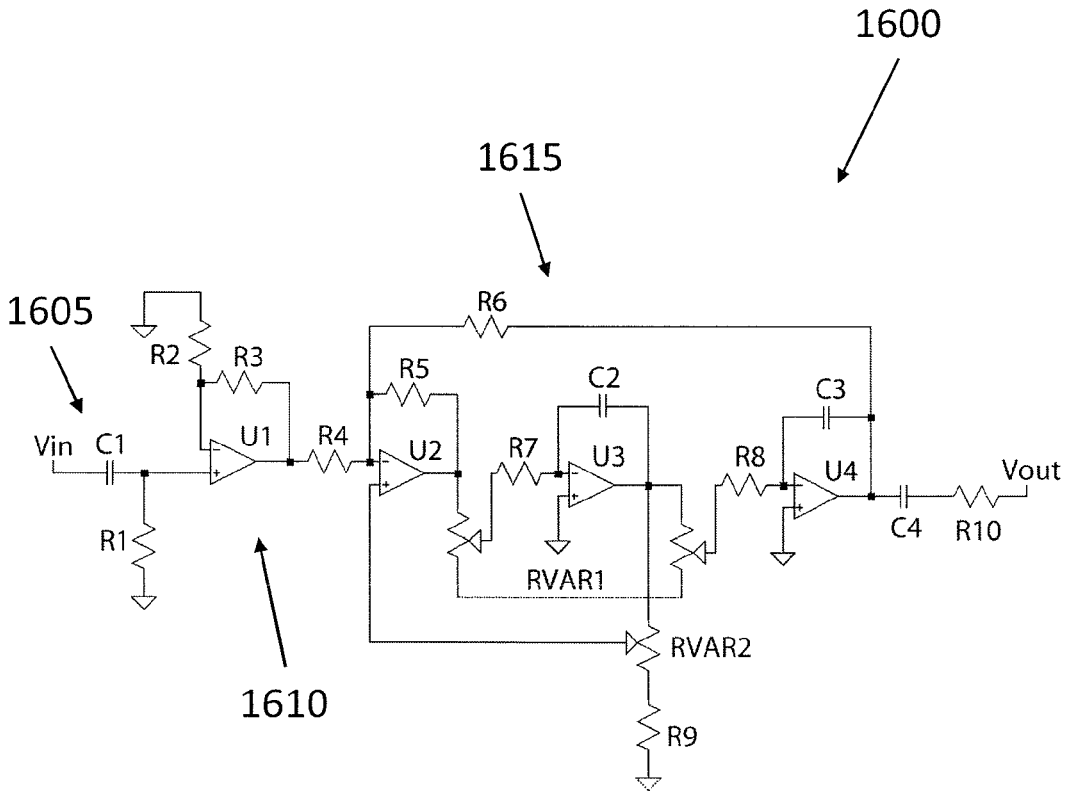
FIG. 16 shows an exemplary schematic depiction of a state variable filter circuit in accordance with aspects of the disclosure.

FIG. 16 shows an exemplary schematic depiction of a state variable filter circuit 1600 in accordance with aspects of the disclosure. FIG. 16 schematically depicts one exemplary and non-limiting embodiment of a tone shaping circuit in accordance with aspects of the embodiments of the disclosure. The disclosure, however, contemplates that other tone shaping circuits than the exemplary state variable filter circuit may be utilized with aspects of the present disclosure. Furthermore, in embodiments of the disclosure, the tone circuit in addition to the tone shaping circuit, may include a signal boost/cut circuit (e.g., as a separate circuit or as part of the tone shaping circuit).

As shown in FIG. 16, the signal from the coils of the pickup goes through a high pass filter 1605, then to a gain or buffer stage 1610 made from operational amplifier U 1. FIG. 16 depicts an exemplary non-inverting configuration, with other configurations contemplated by the present disclosure. The next three stages show a state variable filter 1615, which is used to manipulate sound. The state variable filter 1615 allows the resonant frequency and circuit Q of the outputted signal V out to be independently adjusted through internal control elements and potentiometers which vary RVAR1 and RVAR2, respectively. In embodiments of the present disclosure, a pickup includes actuator elements 202, 204 (e.g., potentiometers) used in conjunction with a tone shaping circuit and configured to vary parameters of the tone shaping circuit, e.g., RVAR1 and RVAR2, to independently adjust resonant frequency and circuit Q of the outputted signal of the pickup.

While the exemplary tone shaping circuit of FIG. 16 is configured to independently adjust resonant frequency and circuit Q of the outputted signal of the pickup, the present disclosure contemplates the actuator elements 202, 204 (e.g., potentiometers) used in conjunction with a tone shaping circuit may be configured to vary different (or additional) parameters of the tone shaping circuit. For example, in embodiments, the actuator elements 202, 204 (e.g., potentiometers) may be configured to respectively vary (e.g., boost/cut) a selected bandwidth of treble frequencies (e.g., treble equalization) and a selected bandwidth of bass frequencies (e.g., bass equalization) of the outputted signal of the pickup. In further embodiments, the actuator elements 202, 204 (e.g., potentiometers) may be configured to respectively vary (e.g., boost/cut) a selected bandwidth of frequencies (e.g., overall tone or equalization) and a volume (or boost) of the outputted signal of the pickup.

In yet further embodiments, the pickup may include more than two actuator elements (e.g., 4 actuator elements), wherein the actuator elements (e.g., potentiometers) may be configured to respectively vary (e.g., boost/cut) a selected bandwidth of frequencies and a volume (or boost), adjust resonant frequency, and circuit Q to affect the outputted signal of the pickup. In yet further embodiments, the four actuator elements (e.g., potentiometers) may be configured to respectively vary may be configured to respectively vary (e.g., boost/cut) a selected bandwidth of treble frequencies and a selected bandwidth of bass frequencies of the outputted signal of the pickup, adjust resonant frequency, and circuit Q to affect the outputted signal of the pickup. In further contemplated embodiments, the pickup may include only a single actuator element configured to adjust one of: resonant frequency; circuit Q; overall tone (e.g., boost/cut a selected bandwidth of frequencies); volume (or boost); treble equalization (e.g., boost/cut a selected bandwidth of treble frequencies); and bass equalization (e.g., boost/cut a selected bandwidth of bass frequencies) to affect the outputted signal of the pickup.

Figure 17:
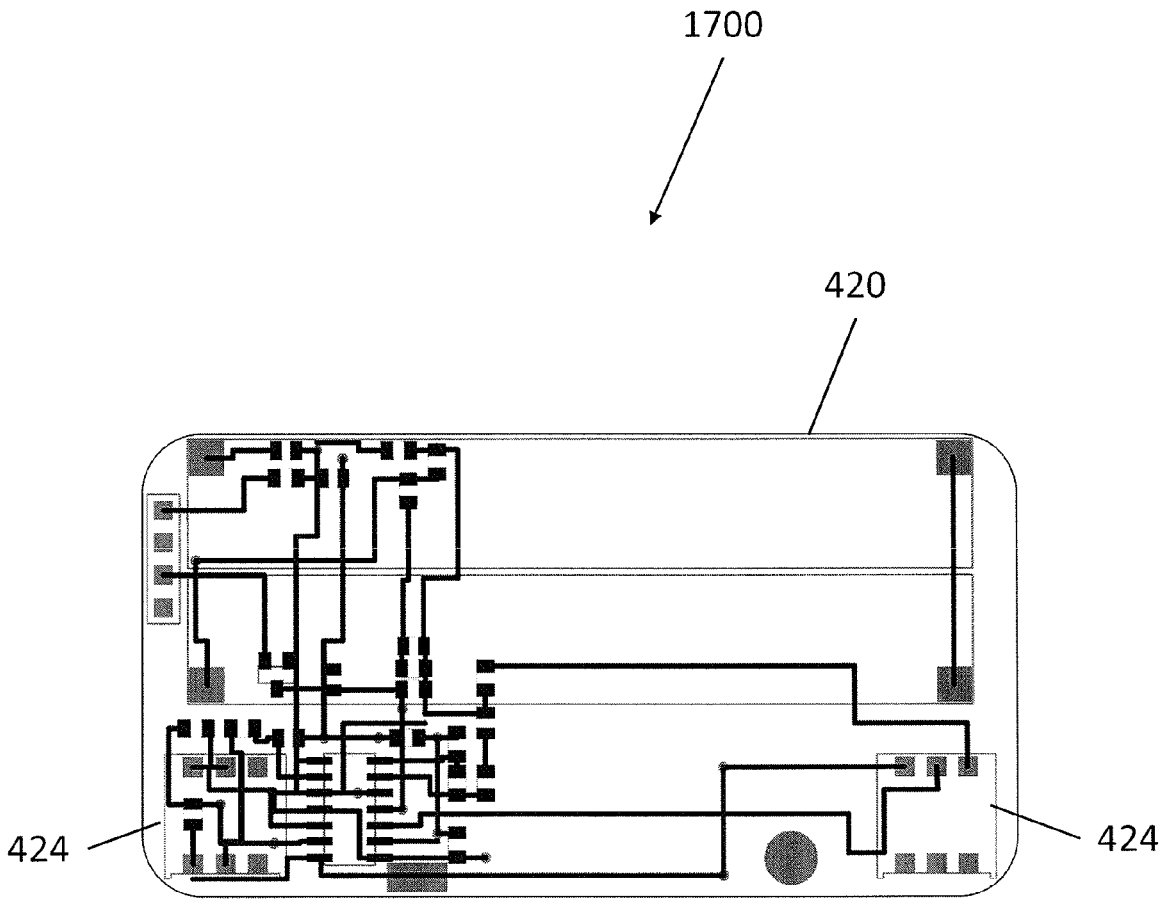
FIG. 17 shows an exemplary layout of a printed circuit board in accordance with aspects of the disclosure.

FIG. 17 shows an exemplary and non-limiting layout 1700 of a printed circuit board 420 in accordance with aspects of the disclosure. The layout 1700 is of the state variable filter circuit 1600 shown in FIG. 16. As shown in FIG. 17, in accordance with aspects of the disclosure, with the representative printed circuit board layout 1700, both the shape and size of the printed circuit board 420 were selected to fit the size of the routed pockets in most guitars, which in this embodiment is humbucker-style pickup. That is, for example, a single coil pickup (which is approximately half the width of a humbucker pickup) would have a smaller printed circuit board. In embodiments, the size of the printed circuit board may be expanded to, for example, allow more functionality of the printed circuit board, but depending, for example, on the shape of the instrument, this may require modification of the body of the guitar or a custom guitar to be fabricated. The grounding planes of the printed circuit board 420 also provide electromagnetic shielding.

As shown in FIG. 17, the exemplary and non-limiting layout 1700 of the printed circuit board 420 includes two footprints 424 (shown by outline) with the necessary connections (e.g., six contacts) for respective connection to the two potentiometers of the actuation elements 202, 204. It should be understood that the disclosure contemplates other layouts of the printed circuit board.

Figure 18:
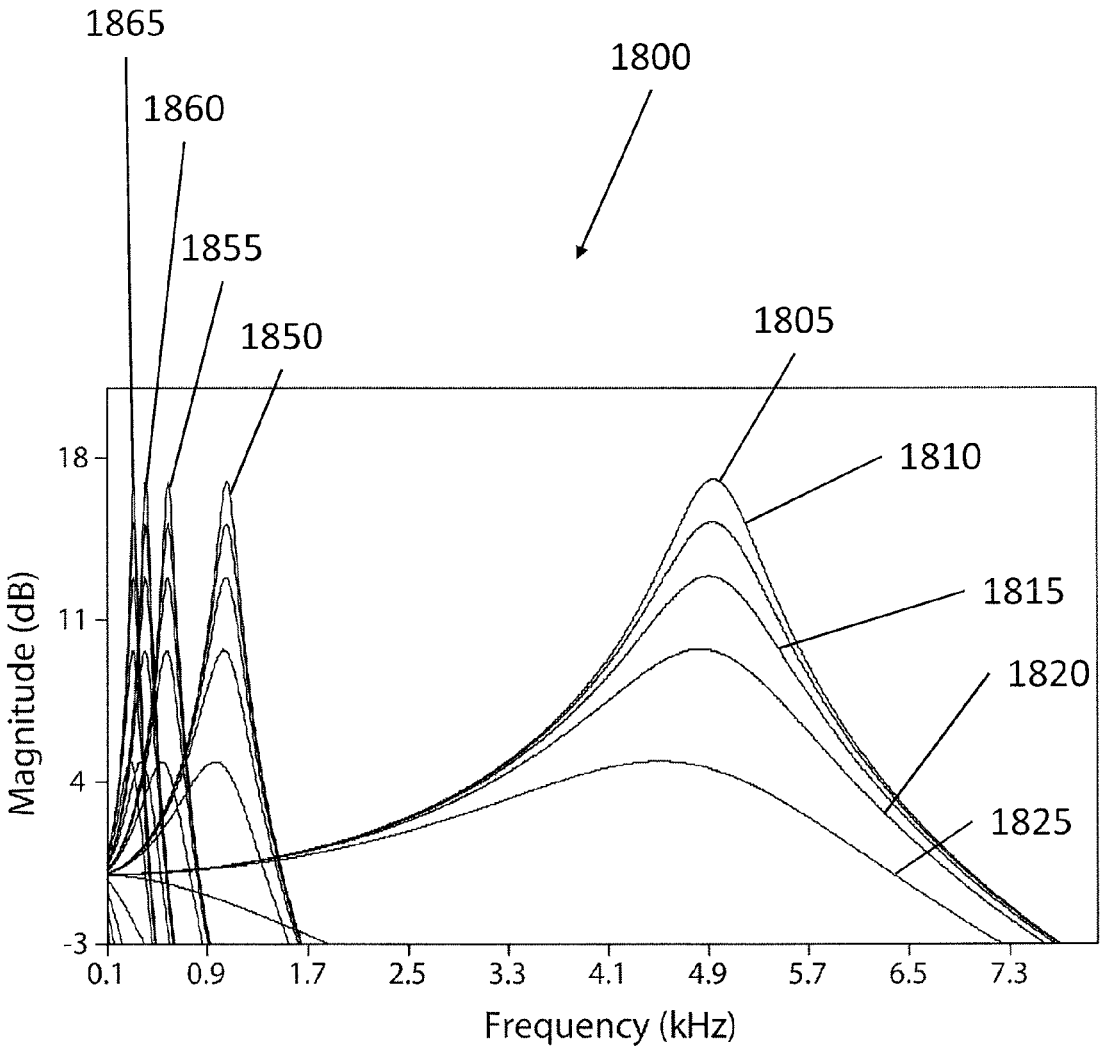
FIG. 18 shows an exemplary Bode plot from the circuit shown in FIG. 16 in accordance with aspects of the disclosure.

FIG. 18 shows an exemplary Bode plot 1800 of representative frequency response curves for different settings of the circuit shown in FIG. 17 in accordance with aspects of the disclosure. As shown in FIG. 18, several exemplary frequency response curves (e.g., 1805, 1810, 1815, 1820, 1825, 1850, 1855, 1860, and 1865) with different values for resonant frequency (e.g., RVAR1) and/or circuit Q (e.g., RVAR2) are depicted. As shown in FIG. 18, each of the frequency response curves (e.g., 1805, 1810, 1815, 1820, 1825, 1850, 1855, 1860, and 1865) has a boost (i.e., increase in magnitude) of varying width (e.g., sharper or broader) centered around a peak resonant frequency. For example, curve 1805 has a boost centered around a peak resonant frequency of approximately 4.9 kHz. In accordance with aspects of the invention, RVAR1 and RVAR2 are continuously variable allowing any frequency range of interest to be completely covered. The resonance peak location (e.g., RVAR1) and width or Q (e.g., RVAR2) can be controlled individually over a wide range of frequencies.

For example, as shown in FIG. 18, by varying the resonant frequency (e.g., by controlling actuator 202 to alter RVAR1), the peak resonant frequency of the circuit output signal can be selected. In accordance with aspects of the disclosure, decreasing the resonant frequency will cause the curve to shift leftward (e.g., from curve 1805, through curves 1850, 1855, 1860, to curve 1865). In other words, decreasing the resonant frequency will cause the peak resonant frequency to shift from a higher frequency (e.g., more treble) to a lower frequency (e.g., more bass). Conversely, increasing the resonant frequency will cause the curve to shift rightward (e.g., from curve 1865, through curves 1860, 1855, and 1850, to curve 1805).

In accordance with further aspects of the disclosure, with the exemplary circuit of FIG. 17, decreasing the Q will cause the peak of the curve to widen and flatten downward (e.g., from curve 1805, through curves 1810, 1815, and 1820, to curve 1825). In other words, decreasing the Q will cause the magnitude of the peak resonant frequency to decrease (e.g., lower boost relative to other frequencies) and the width of boosted frequencies around the peak resonant frequency to increase (e.g., wider peak). Increasing the Q will cause the magnitude of the peak resonant frequency to increase (e.g., higher boost relative to other frequencies) and the width of boosted frequencies around the peak resonant frequency to decrease (e.g., narrower peak). In other words, in accordance with aspects of the disclosure, increasing Q alters the response curve from a relatively lower and wider peak resonant frequency to a relatively higher and narrower peak resonant frequency, whereas decreasing Q alters the response curve from a relatively higher and narrower peak resonant frequency to a relatively lower and wider peak resonant frequency. Other curves (unlabeled) depicted in FIG. 18 represent frequency response curves when both variables (i.e., peak frequency and Q) are adjusted relative to the values for curve 1805.

As should be understood, many types of active circuits are possible giving a variety of tonal and external integrated control options. Other embodiments may include, for example, balanced or slightly unbalanced differential input circuits for noise reduction and/or the production of characteristic tones.

Figure 19:
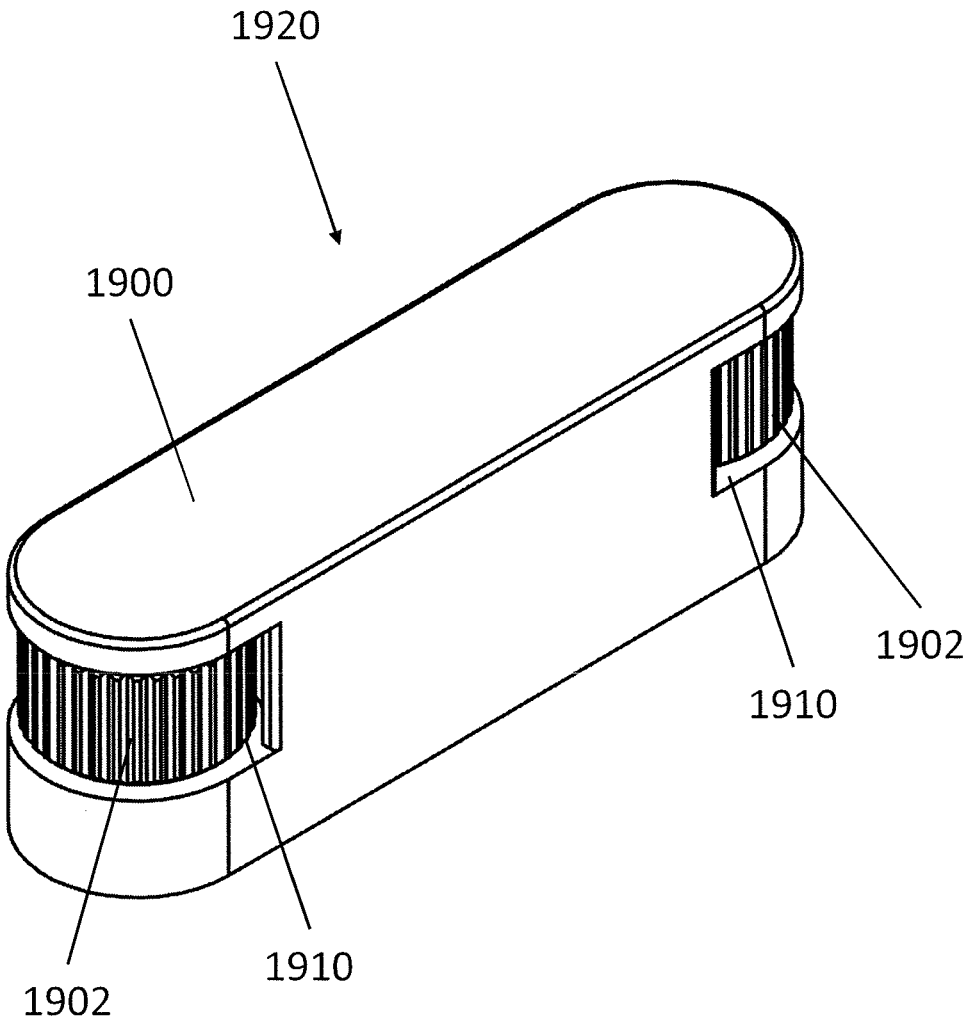
FIG. 19 shows a perspective view of an exemplary single coil pickup with integrated controls in accordance with aspects of the disclosure.

FIG. 19 shows a perspective view of an exemplary single coil pickup 1920 with integrated controls in accordance with aspects of the disclosure. In contrast to a humbucker pickup, a single coil pickup (e.g., pickup 1920) is narrower in the string extension direction (see, e.g., FIG. 1.) As shown in FIG. 19, the pickup 1920 includes actuator elements 1902, 1904 integrated into cavities 1910 in the pickup body 1900. In this exemplary and non-limiting embodiment, the actuator elements are knobs 1902 and 1904. In embodiments, the actuator elements 1902 and 1904 are recessed into the pickup body 1900 to avoid interference with the strings and/or to maintain playability. Moreover, as shown in FIG. 19, the actuator elements 1902 and 1904 are "hidden," in that they are obscured by the pickup body 1900 when viewed from the top (which is the view most observed from a guitarist's audience). In accordance with aspects of the disclosure, the actuator elements 1902 and 1904 may be "hidden" so that the pickup appears to a viewer (e.g., audience member) to be a conventional pickup (i.e., without integrated controls). In embodiments, the actuator elements 1902 and 1904 are also situated in respective ends of the pickup body 1900 to facilitate adjustment while playing.

Figure 20:
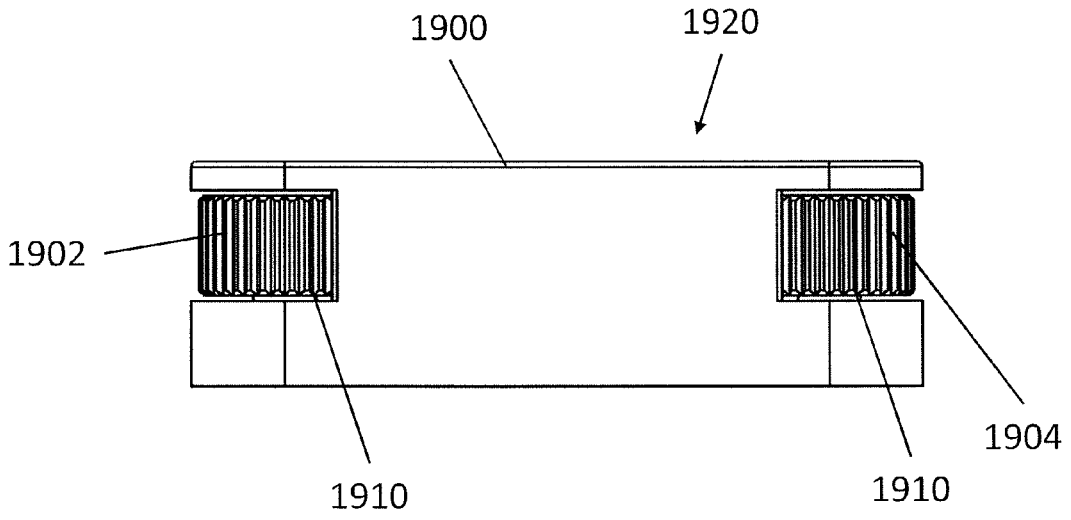
FIG. 20 shows a side view of the exemplary single coil pickup with integrated controls shown in FIG. 19 in accordance with aspects of the disclosure.

FIG. 20 shows a side view of the exemplary single coil pickup 1920 with integrated controls shown in FIG. 19 in accordance with aspects of the disclosure. As shown in FIG. 20, the pickup 1920 includes actuator elements 1902, 1904 integrated into the pickup body 1900. As shown in FIG. 20, the actuator elements 1902 and 1904 are recessed into the pickup body 1900 to avoid interference with the strings and/or maintain playability. Moreover, as shown in FIG. 20, the actuator elements 1902 and 1904, while "hidden," are viewable from the side view.

Figure 21:
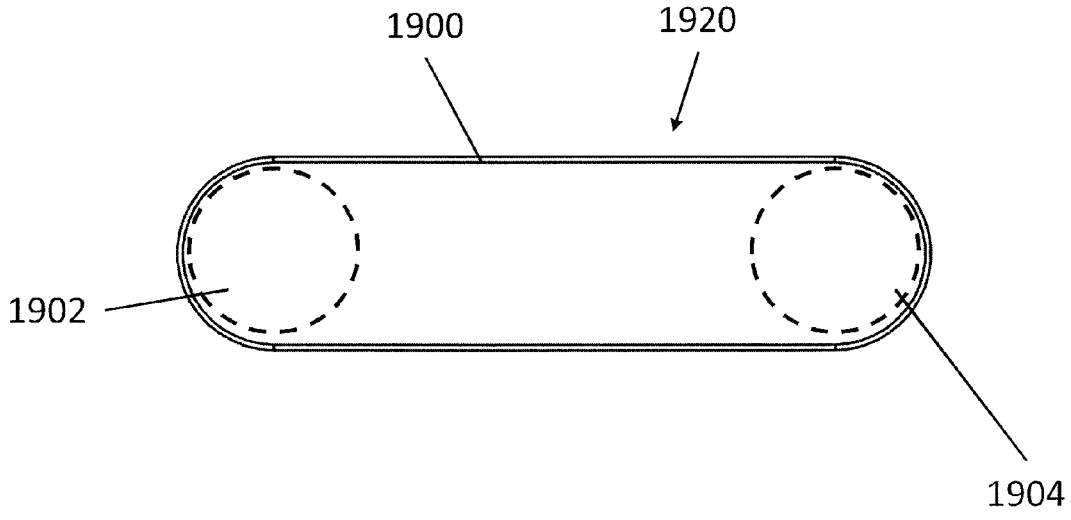
FIG. 21 shows a schematic top view of the exemplary single coil pickup with integrated controls shown in FIG. 19 in accordance with aspects of the disclosure.

FIG. 21 shows a top view of the exemplary single coil pickup 1920 with integrated controls shown in FIG. 19 in accordance with aspects of the disclosure. As shown in FIG. 21, the pickup 1920 includes actuator elements 1902, 1904 integrated into the pickup body 1900. As shown in FIG. 21, the actuator elements 1902 and 1904 are recessed into the pickup body 1900 to avoid interference with the strings and/or to maintain playability. Moreover, as shown in FIG. 21, the actuator elements 1902 and 1904 are "hidden" in that they are obscured by the pickup body 1900 when viewed from the top.

Figure 22:
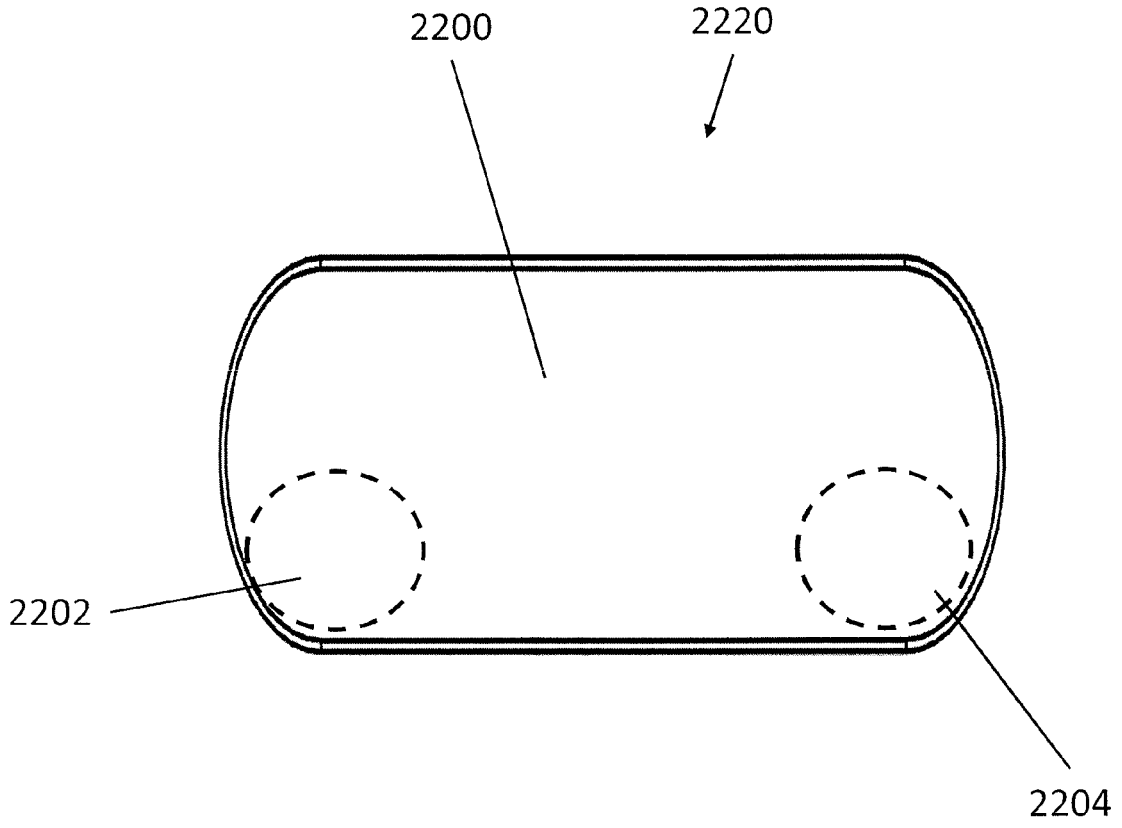
FIG. 22 shows a top view of an exemplary humbucker pickup with integrated "hidden" controls in accordance with aspects of the disclosure.

FIG. 22 shows a schematic top view of an exemplary humbucker pickup 2220 with integrated "hidden" controls in accordance with aspects of the disclosure. As shown in FIG. 22, the pickup 2220 includes actuator elements 2202, 2204 integrated into the pickup body 2200. As shown in FIG. 22, the actuator elements 2202 and 2204 are recessed into cavities (not shown) of the pickup body 2200 to avoid interference with the strings and/or to maintain playability. Moreover, as shown in FIG. 22, the actuator elements 2202 and 2204 are "hidden" in that they are obscured by the pickup body 2200 when viewed from the top. As should be understood, however, the actuator elements 2202 and 2204 are accessible from the side of the pickup (similar to the embodiment of FIG. 20).

Figure 23:
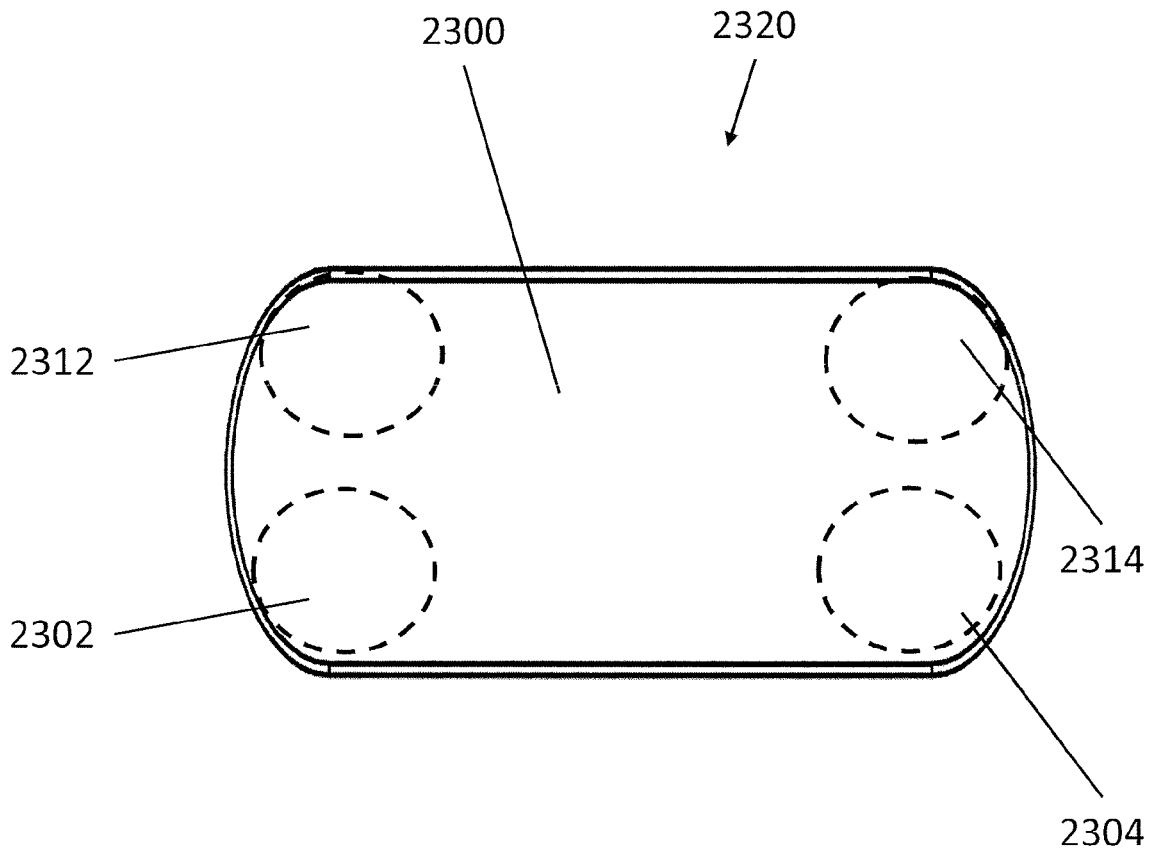
FIG. 23 shows a top view of an exemplary humbucker pickup with four integrated "hidden" controls in accordance with aspects of the disclosure.

FIG. 23 shows a top view of an exemplary humbucker pickup 2320 with four integrated "hidden" controls in accordance with aspects of the disclosure. As shown in FIG. 23, the pickup 2320 includes four actuator elements 2302, 2304, 2312, 2314 integrated into cavities (not shown) of the pickup body 2300. As shown in FIG. 23, the actuator elements 2302, 2304, 2312, 2314 are recessed into the pickup body 2300 to avoid interference with the strings and/or to maintain playability. Moreover, as shown in FIG. 22, the actuator elements 2302, 2304, 2312, 2314 are "hidden" in that they are obscured by the pickup body 2300 when viewed from the top.

Figure 24:
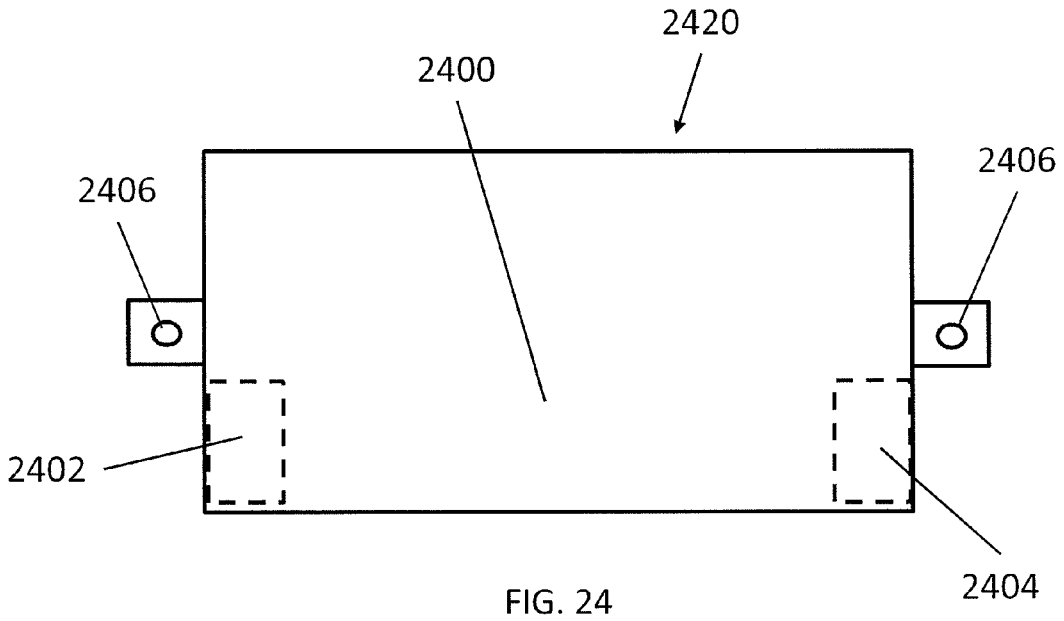
FIG. 24 shows a top view of an exemplary humbucker pickup with integrated "hidden" controls in accordance with aspects of the disclosure.

FIG. 24 shows a top view of an exemplary humbucker pickup 2420 with integrated "hidden" controls in accordance with aspects of the disclosure. As shown in FIG. 24, the pickup 2420 includes actuator elements 2402, 2404 integrated into cavities (not shown) of the pickup body 2400. The pickup 2420 also includes mounting holes 2406 to utilize screws, springs, and a pickup ring assembly for pickup attachment and/or height adjustment. As shown in FIG. 24, the actuator elements 2402 and 2404 are recessed into the pickup body 2400 to avoid interference with the strings and/or to maintain playability. Moreover, as shown in FIG. 24, the actuator elements 2402 and 2404 are "hidden" in that they are obscured by the pickup body 2400 when viewed from the top.

Figure 25:
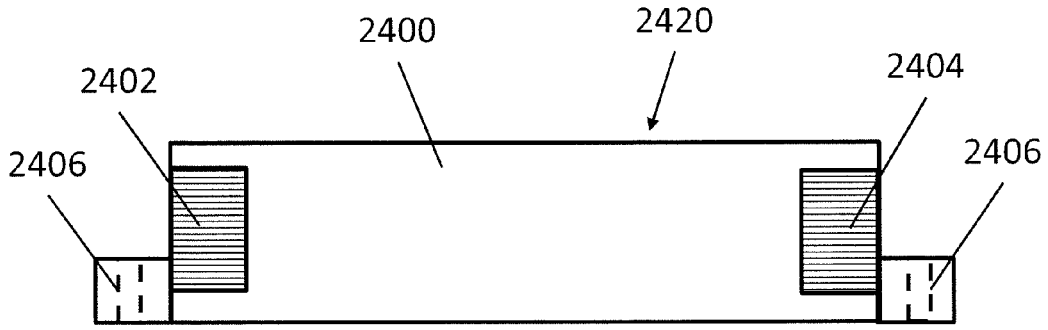
FIG. 25 shows a side view of the exemplary humbucker pickup with integrated "hidden" controls shown in FIG. 24 in accordance with aspects of the disclosure.

FIG. 25 shows a side view of the exemplary humbucker pickup 2420 with integrated "hidden" controls shown in FIG. 24 in accordance with aspects of the disclosure. As shown in FIG. 25, the pickup 2420 includes actuator elements 2402, 2404 integrated into cavities (not shown) of the pickup body 2400. In accordance with aspects of the disclosure, the actuator elements 2402 and 2404 are recessed into the pickup body 2400 to avoid interference with the strings and/or maintain playability. Moreover, as shown in FIG. 24, the actuator elements 2402 and 2404, while "hidden," are viewable from the side view. With pickup 2420, the rotational axis of actuator elements 2402, 2404 is approximately parallel with the mounting face of the instrument. In contrast, with pickup 2220, for example, the rotational axis of actuator elements 2202, 2204 is approximately perpendicular to the mounting face of the instrument (see FIG. 22).

Figure 26:
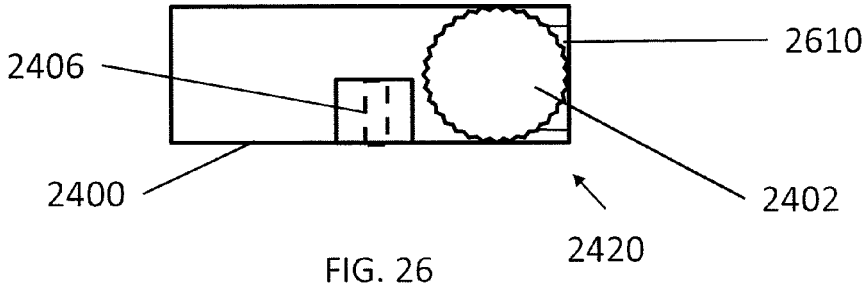
FIG. 26 shows another side view of the exemplary humbucker pickup with integrated "hidden" controls shown in FIG. 24 in accordance with aspects of the disclosure.

FIG. 26 shows another side view of the exemplary humbucker pickup 2420 with integrated "hidden" controls shown in FIG. 24 in accordance with aspects of the disclosure. As shown in FIG. 26, the pickup 2420 includes actuator elements 2402, 2404 integrated into the pickup body 2400. In accordance with aspects of the disclosure, the actuator elements 2402 and 2404 are recessed into cavities 2610 in the pickup body 2400 to avoid interference with the strings and/or maintain playability. Moreover, as shown in FIG. 26, the actuator elements 2402 and 2404, while "hidden," are viewable from the side view.

Figure 27:
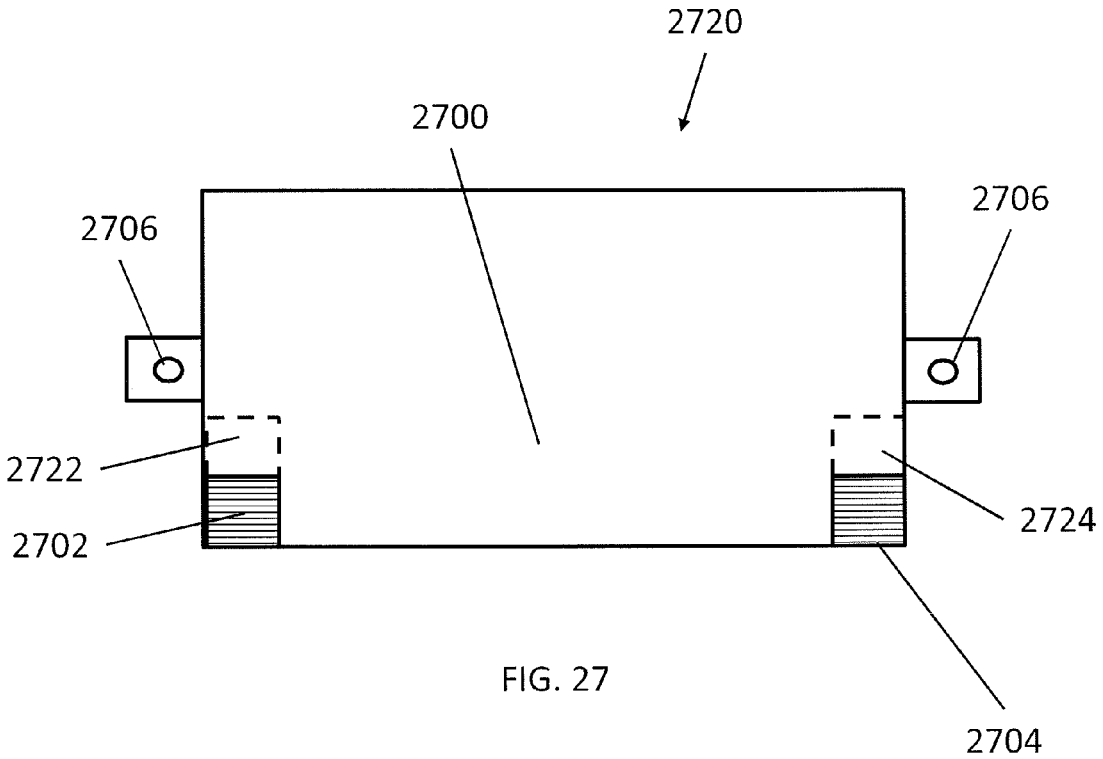
FIG. 27 shows a top view of an exemplary humbucker pickup with integrated "partially-hidden" controls in accordance with aspects of the disclosure.

FIG. 27 shows a top view an exemplary humbucker pickup 2720 with integrated "partially-hidden" controls in accordance with aspects of the disclosure. As shown in FIG. 27, the pickup 2720 includes actuator elements 2702, 2704 integrated into the pickup body 2700. The pickup 2720 also includes mounting holes 2706 to utilize screws, springs, and pickup ring assembly for pickup attachment and height adjustment. As shown in FIG. 27, the actuator elements 2702 and 2704 are recessed into the pickup body 2700 to avoid interference with the strings and/or to maintain playability. Moreover, as shown in FIG. 27, the actuator elements 2702 and 2704 are "partially-hidden" in that they are partially obscured by the pickup body 2700 when viewed from the top. For example, as shown in FIG. 27, region 2722 of actuator 2702 is obscured by the pickup body 2700, and region 2724 of actuator 2704 is obscured by the pickup body 2700.

Figure 28:
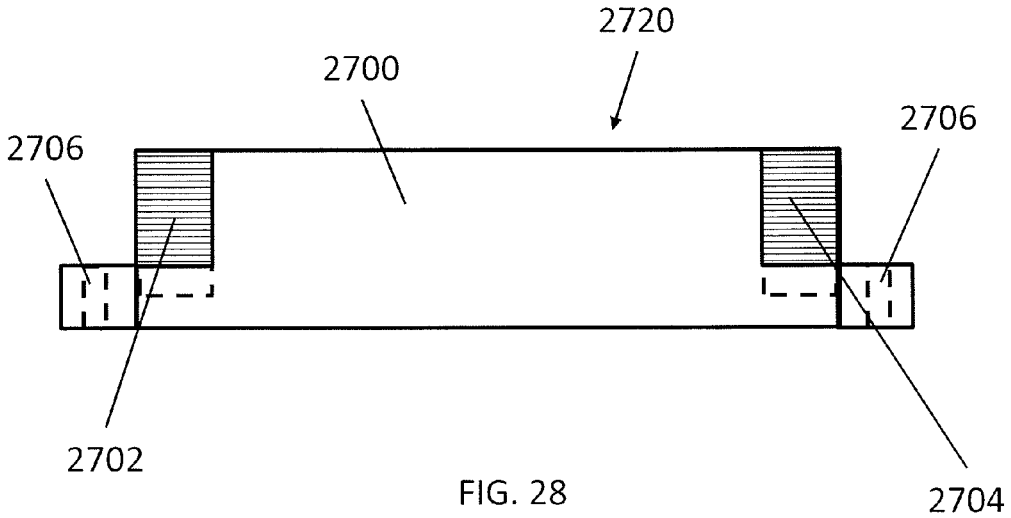
FIG. 28 shows a side view of the exemplary humbucker pickup with integrated "partially-hidden" controls shown in FIG. 27 in accordance with aspects of the disclosure.

FIG. 28 shows a side view of the exemplary humbucker pickup 2720 with integrated "partially-hidden" controls shown in FIG. 27 in accordance with aspects of the disclosure. As shown in FIG. 28, the pickup 2720 includes actuator elements 2702, 2704 integrated into cavities (not shown) of the pickup body 2700. In accordance with aspects of the disclosure, the actuator elements 2702 and 2704 are recessed into the pickup body 2700 to avoid interference with the strings and/or to maintain playability. Moreover, as shown in FIG. 27, the actuator elements 2702 and 2704, while "partially-hidden," are at least partially-viewable from the side view. With pickup 2720, the rotational axis of actuator elements 2702, 2704 is approximately parallel with the mounting face of the instrument.

In accordance with aspects of the disclosure, in embodiments, rotational actuator elements may freely rotate through the range of motion (e.g., 300°). In further embodiments, rotational actuator elements (or linear actuator elements) may include one or more detents. For example, an actuator element may include a single center detent (e.g., a home position), or an actuator may include a plurality of detents over the range of motion of the actuator, to select discrete settings for the actuator.

Figure 29:
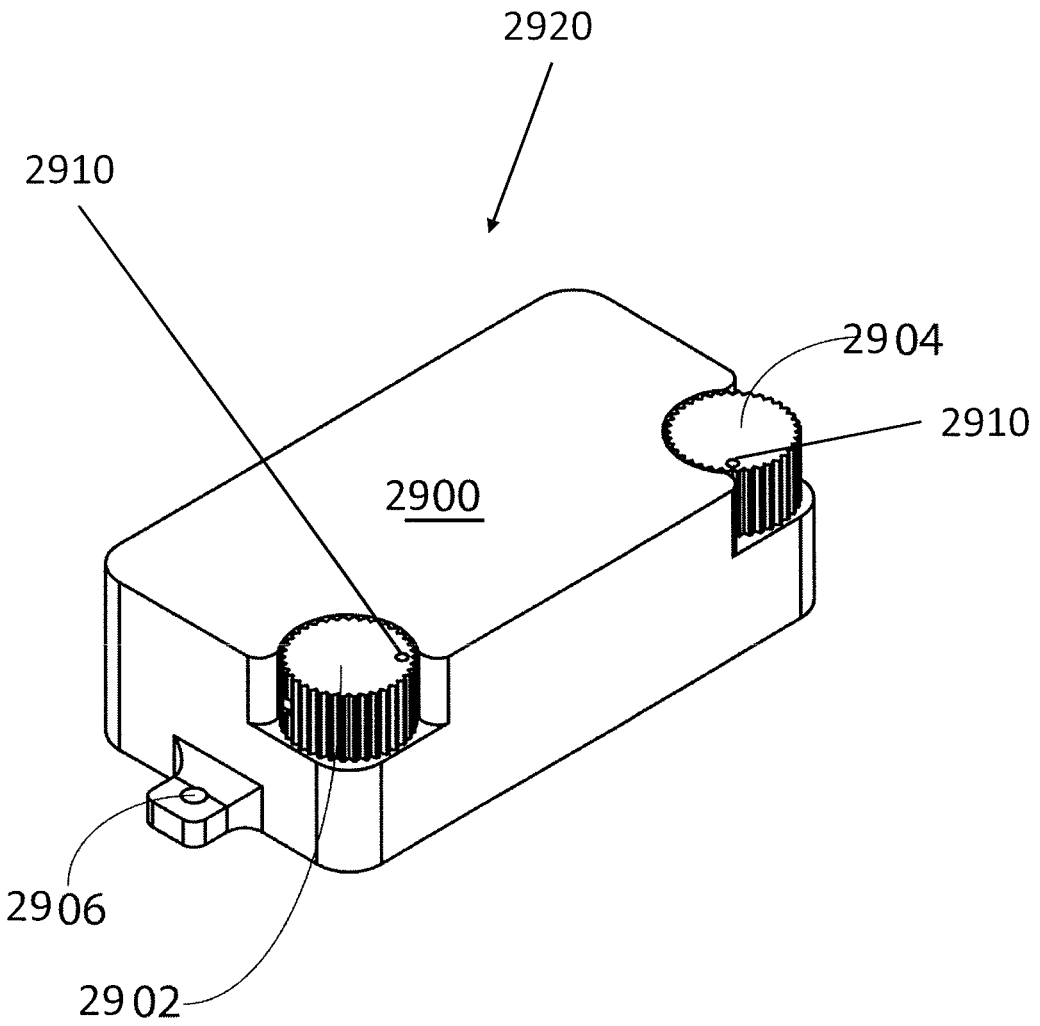
FIG. 29 shows a perspective view of an exemplary pickup with integrated "locking" controls in accordance with aspects of the disclosure.

FIG. 29 shows a perspective view of an exemplary pickup 2920 with integrated "locking" controls in accordance with aspects of the disclosure. As shown in FIG. 29, the pickup 2920 includes two actuator elements 2902 and 2904 integrated into cavities (not shown) of the pickup body 2900. In accordance with aspects of the disclosure, each of the actuator elements 2902 and 2904 includes a locking mechanism 2910 structured and arranged to selectively lock the rotational position of the respective actuator elements 2902 and 2904. For example, once a user positions one or more of the actuator elements 2902 and 2904, the user can engage the respective locking mechanism 2910 to lock the actuator element in its current position, which prevents inadvertent movement of the actuator elements, e.g., when playing the instrument. In embodiments, the locking mechanism 2910 may include a locking screw (e.g., a grub screw or set screw), whose distal tip end, upon being screwed into a locking position, impacts the pickup body 2900 (or a layer, e.g., a washer, on the pickup body 2900) under the respective actuator element so as to prevent movement of the actuator element.

Figure 30:
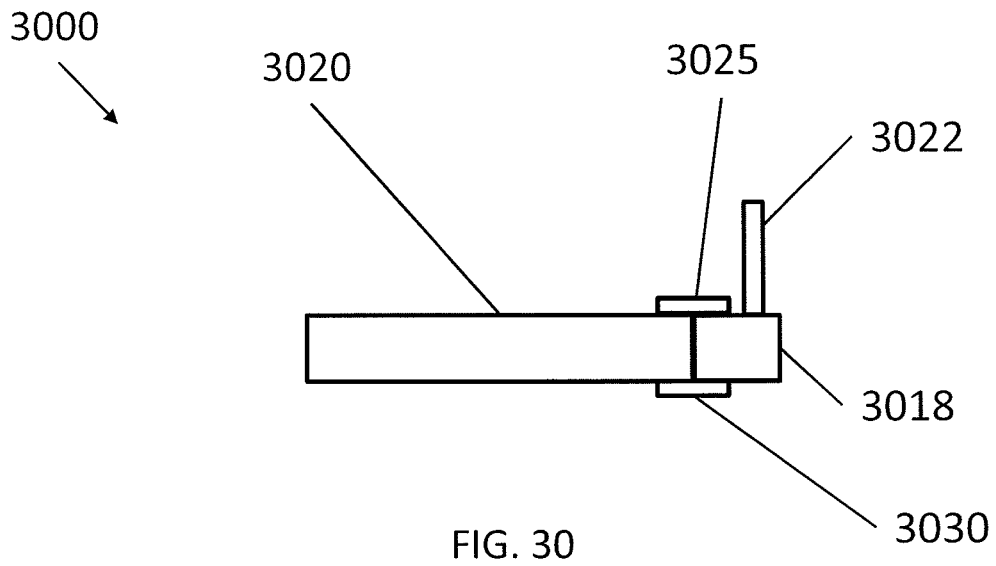
FIG. 30 schematically depicts a side view of an exemplary alternative potentiometer mounting in accordance with aspects of the disclosure.

FIG. 30 schematically depicts a side view of an exemplary alternative potentiometer mounting 3000 in accordance with aspects of the disclosure. As shown in FIG. 30, a potentiometer (or pot) 3018 is mounted along a side surface of a printed circuit board 3020, with, for example, one or more upper (e.g., three) contacts 3025 and one or more (e.g., three) lower contacts 3030. In accordance with aspects of the disclosure, by mounting the potentiometer 3018 along a side surface of the printed circuit board 3020, the overall height of the structure is reduced and potentiometer posts 3022 do not extend as far vertically (as compared to an embodiment where the potentiometers are mounted on a top surface of the printed circuit board (see, e.g., FIG. 3).

Figure 31:
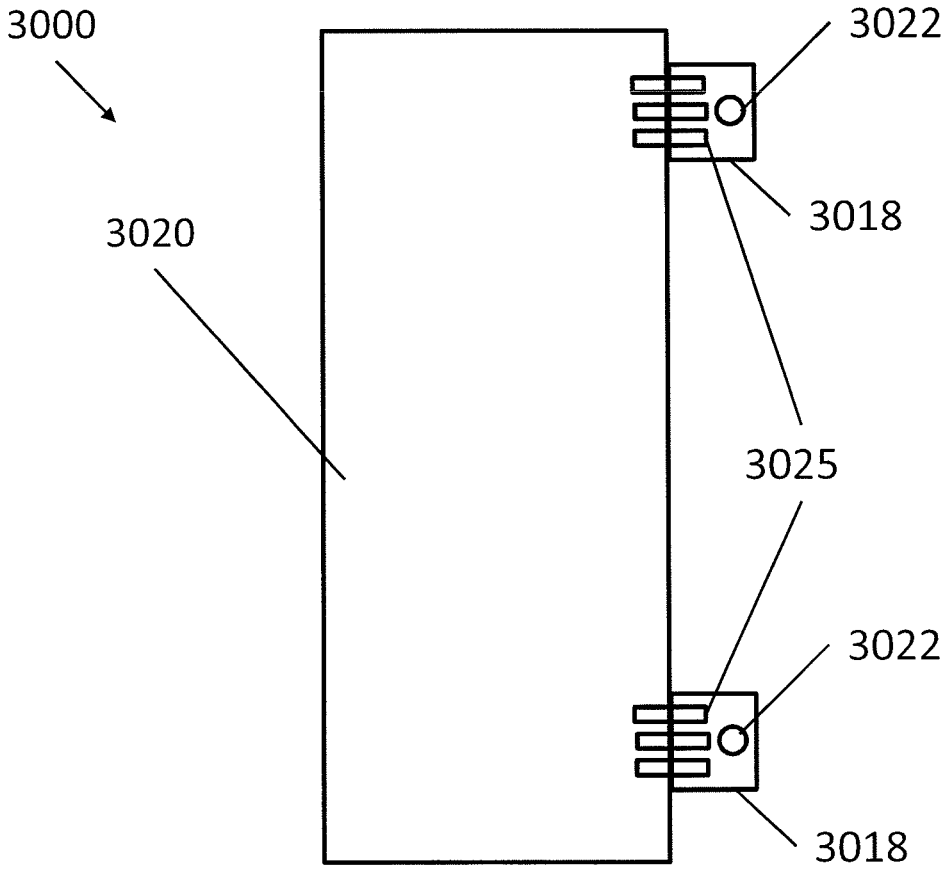
FIG. 31 schematically depicts a top view of the exemplary alternative potentiometer mounting shown in FIG. 30 in accordance with aspects of the disclosure.

FIG. 31 schematically depicts a top view of the exemplary alternative potentiometer mounting 3000 shown in FIG. 30 in accordance with aspects of the disclosure. As shown in FIG. 31, with this exemplary embodiment, two potentiometers 3018 are mounted along a side surface of the printed circuit board 3020, with, for example, one or more upper contacts 3025 and one or more lower contacts (not shown).

Figure 32:
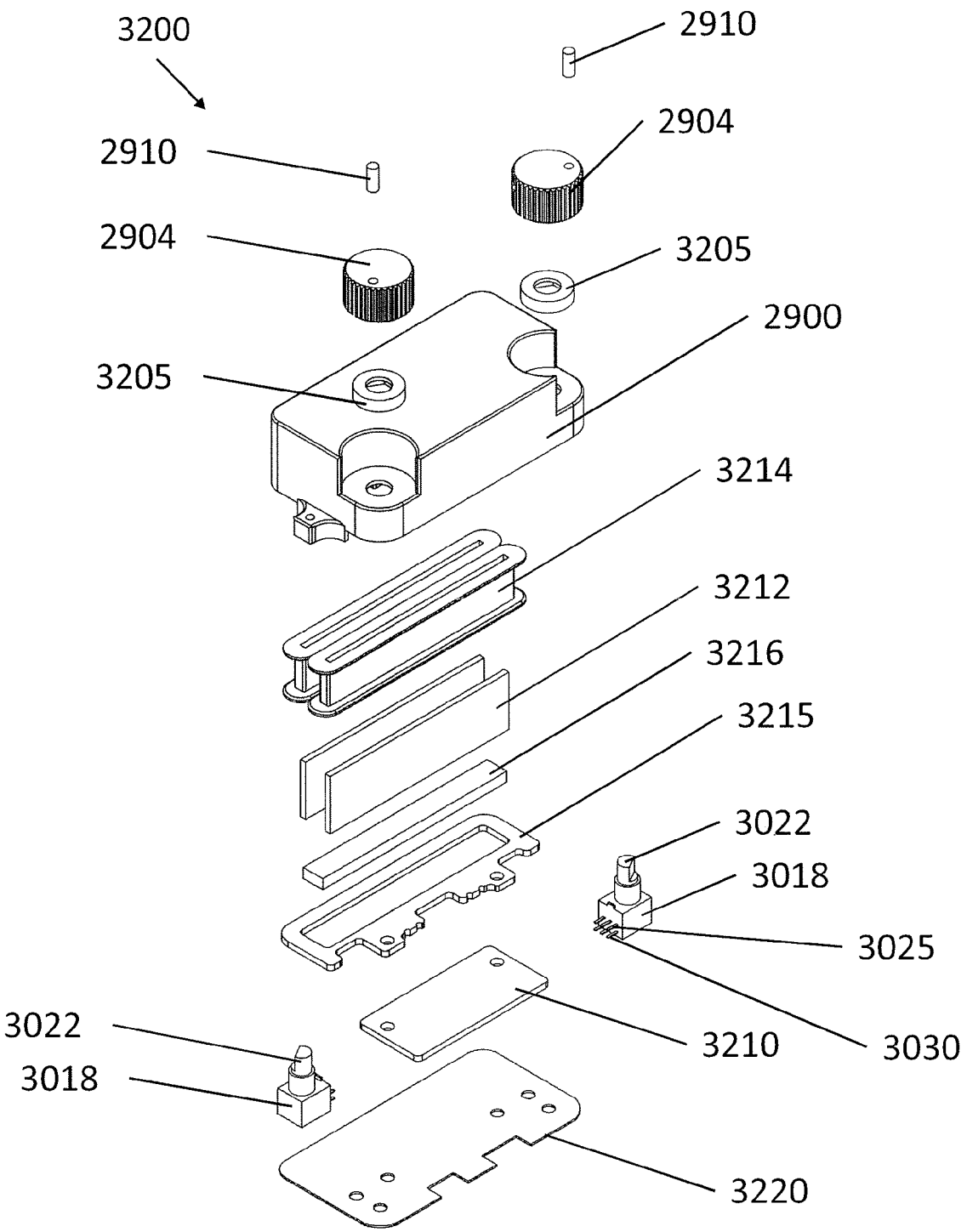
FIG. 32 shows a perspective exploded view of exemplary pickup with integrated "locking" controls and alternative potentiometer mounting in accordance with aspects of the disclosure.

FIG. 32 shows a perspective exploded view of exemplary pickup 3200 with integrated "locking" controls and alternative potentiometer mounting in accordance with aspects of the disclosure. As shown in FIG. 32, the pickup 3200 includes two actuator elements 2902 and 2904 integrated into cavities of the pickup body 2900. In accordance with aspects of the disclosure, each of the actuator elements 2902 and 2904 includes a locking mechanism 2910 structured and arranged to selectively lock the rotational position of the respective actuator elements 2902 and 2904. In embodiments, the locking mechanism 2910 includes set screws used to lock the actuator elements 2902 and 2904 in a fixed position to prevent them from being bumped during playing and locking in the sound. For example, once a user positions one or more of the actuator elements 2902 and 2904, the user can engage the respective locking mechanism 2910 to lock the actuator element in its current position, which prevents inadvertent movement of the actuator elements, e.g., when playing the instrument. In embodiments, the locking mechanism 2910 may include a locking screw (e.g., a grub screw or set screw), whose distal tip end, upon being screwed into a locking position, impacts (or impinges upon) the pickup body 2900 (or a layer, e.g., a washer or plastic spacer 3205, on the pickup body 2900) under the respective actuator element so as to prevent movement of the actuator element.

As shown in FIG. 32, a metal plate 3220, which is used to provide additional shielding and a clean, aesthetically-pleasing look, forms the base of the pickup 3200. As further shown in FIG. 32, the pickup 3200 includes two circuit boards 3210 and 3215. With this exemplary embodiment, circuit board 3210 contains the main circuit (e.g., tone shaping circuit) and circuit board 3215 is structured and arranged to hold the coils 3214, magnet 3212, and a flux transfer element 3216, which form a magnetic assembly.

To fit components of the pickup 3200 in a very compact form factor, in accordance with aspects of the disclosure, circuit board 3215 may include one or more castellations 3225. When assembled, the potentiometers 3018, which are mounted to circuit board 3210, are respectively accommodated within castellations 3225.

Additionally, in embodiments, as shown in FIG. 32, the potentiometers 3018 may utilize board edge connections, in which the potentiometer (or pot) 3018 is mounted along a side surface of a printed circuit board 3210, with, for example, one or more upper (e.g., three) contacts 3025 and one or more (e.g., three) lower contacts 3030. In accordance with aspects of the disclosure, by mounting the potentiometer 3018 along a side surface of the printed circuit board 3210, the overall height of the pickup 3200 is reduced and potentiometer posts 3022 do not extend as far vertically (as compared to an embodiment where the potentiometers are mounted on a top surface of the printed circuit board (see, e.g., FIG. 3).

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A musical instrument pickup, comprising:

a base having a footprint size approximating either one single coil pickup footprint size or one humbucker pickup footprint size;

a magnetic assembly on the base;

a pickup body substantially covering the magnetic assembly and forming a pickup housing with the base;

a tone shaping electrical circuit arranged within the pickup housing; and at least one integrated control in and/or on the pickup body, wherein the musical instrument pickup is arrangable within a pickup cavity sized to accommodate either only one single coil pickup or only one humbucker pickup.

2. The pickup of claim 1, wherein the at least one integrated control comprises two integrated controls.

3. The pickup of claim 1, wherein the at least one integrated control comprises more than two integrated controls.

4. The pickup of claim 1, wherein the at least one integrated control is configured to vary one or more parameters of the tone shaping circuit to adjust a frequency response and/or volume of the pickup.

5. The pickup of claim 1, wherein the at least one integrated control is configured to adjust at least one of a peak resonant frequency of the pickup, a Q for the pickup, a volume of the pickup, and equalization of the pickup.

6. The pickup of claim 2, wherein the two integrated control comprise rotationally-actuated knobs structured and arranged at respective longitudinal ends of the pickup body.

7. The pickup of claim 6, wherein the two integrated controls are structured and arranged at respective rounded corners of the pickup body.

8. The pickup of claim 1, wherein the base comprises a printed circuit board having the tone shaping circuit, wherein each of the at least one integrated control comprises:

a potentiometer mounted to the printed circuit board and having a mounting post projecting through the pickup body; and an actuator element arranged in an external surface cavity of the pickup body and mounted to the mounting post.

9. The pickup of claim 8, wherein the potentiometer is mounted to a top surface of the printed circuit board.

10. The pickup of claim 8, wherein the potentiometer is mounted to a side surface of the printed circuit board.

11. The pickup of claim 1, wherein the at least one integrated control is structured and arranged such that the at least one integrated control does not project beyond an outer perimeter of the pickup body.

12. The pickup of claim 1, wherein the pickup is configured as a humbucker arrangeable within the cavity sized to accommodate the humbucker pickup.

13. The pickup of claim 1, wherein the pickup is configured as a single coil arrangeable within the cavity sized to accommodate the single coil pickup.

14. The pickup of claim 1, wherein the at least one integrated control is a rotary actuator having a rotational axis perpendicular to an upper surface of the printed circuit board.

15. The pickup of claim 1, wherein the at least one integrated control is a rotary actuator having a rotational axis parallel to an upper surface of the printed circuit board.

16. The pickup of claim 7, wherein the pickup body includes four rounded corners, which include two larger rounded corners where the two actuator elements are respectively structured and arranged, and two smaller rounded corners opposite the two larger rounded corners.

17. The pickup of claim 1, further comprising a pickup ring structured and arranged to surround a perimeter of the pickup body.

18. The pickup of claim 17, wherein at least one of the pickup body and the pickup ring include indicator features for the at least one integrated control.

19. The pickup of claim 17, wherein the pickup ring includes one or more recessed areas to provide increased access to the at least one integrated control.

20. The pickup of claim 1, wherein the at least one integrated control includes a locking element structured and arranged to releasably lock a relative position of the integrated control.

21. The pickup of claim 1, wherein the at least one integrated control comprises one of or more of a rotationally-actuated knob, a switch, a slider, and a button.

22. The pickup of claim 1, wherein the at least one integrated control comprises a touch sensitive control.

23. A pickup ring structured and arranged to surround the pickup of claim 1, the pickup ring having four internal rounded corners, wherein two of the internal rounded corners have a larger relative radius, and the remaining two internal rounded corners have a smaller relative radius.

24. The pickup of claim 1, wherein the pickup body and the base substantially enclose the magnetic assembly.

25. A musical instrument pickup, comprising:

a base having a footprint size approximating either one single coil pickup footprint size or one humbucker pickup footprint size;

a piezo pickup assembly on the base;

a pickup body substantially covering the piezo pickup assembly and forming a pickup housing with the base;

a tone shaping electrical circuit arranged within the pickup housing; and at least one integrated control in and/or on the pickup body, wherein the musical instrument pickup is arrangable within a pickup cavity sized to accommodate either only one single coil pickup or only one humbucker pickup.

26. A musical instrument pickup, comprising:

a pickup magnetic assembly having sides and a top;

a pickup body within which the pickup magnetic assembly is arranged, wherein the pickup body substantially completely covers at least the sides of the pickup magnetic assembly and wherein the pickup body has a footprint size approximating either one single coil pickup footprint size or one humbucker pickup footprint size;

a tone shaping electrical circuit configured for adjusting the tone of the pickup magnetic assembly, wherein the tone shaping circuit is arranged within the pickup body; and at least one integrated control in and/or on the pickup body, wherein the musical instrument pickup is arrangeable within a pickup cavity sized to accommodate either only one single coil pickup or only one humbucker pickup.

27. The musical instrument pickup of claim 26, wherein the at least one integrated control includes a connector and an actuator;

wherein the pickup body includes at least one external surface cavity in which the actuator is arranged, and wherein the connector projects from within the pickup body into the at least one external surface cavity and is attached to the actuator.

28. The musical instrument pickup of claim 26, wherein the top of the pickup magnetic assembly is configured for facing strings of a musical instrument.

* * * * *